US010773528B2

(12) United States Patent
Kawahara

(10) Patent No.: US 10,773,528 B2
(45) Date of Patent: Sep. 15, 2020

(54) PRINTING APPARATUS, PRINTING CONTROL TERMINAL, PRINTING APPARATUS CONTROLLING METHOD, PRINTING CONTROL TERMINAL CONTROLLING METHOD, AND RECORDING MEDIA

(71) Applicant: CASIO COMPUTER CO., LTD., Shibuya-ku, Tokyo (JP)

(72) Inventor: Toshihisa Kawahara, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/206,514

(22) Filed: Nov. 30, 2018

(65) Prior Publication Data

US 2019/0176481 A1 Jun. 13, 2019

(30) Foreign Application Priority Data

Dec. 8, 2017 (JP) ..... 2017-236303

(51) Int. Cl.
*B41J 2/355* (2006.01)
*B41J 3/407* (2006.01)

(52) U.S. Cl.
CPC ..... *B41J 2/3558* (2013.01); *B41J 3/4075* (2013.01)

(58) Field of Classification Search
CPC ..... B41J 29/38; B41J 2/3558; B41J 3/4075; G06K 15/4055
See application file for complete search history.

(56) References Cited

U.S. PATENT DOCUMENTS 5,182,583 A * 1/1993 Horigome ..... B41J 2/1652 324/429
7,014,375 B2 * 3/2006 Nagae ..... B41J 29/38 400/120.01
7,880,908 B2 2/2011 Suzuki
8,553,055 B1 * 10/2013 Martell ..... B41J 29/13 347/192
8,684,481 B2 4/2014 Tanizaki et al.
9,205,671 B1 * 12/2015 Simmons ..... G06F 3/1292
2002/0021348 A1 * 2/2002 Takahashi ..... B41J 2/3553 347/171
2002/0033872 A1 * 3/2002 Takahashi ..... B41J 29/38 347/110

(Continued)

FOREIGN PATENT DOCUMENTS

JP 2005343084 A 12/2005
JP 2007293819 A 11/2007
JP 2013132803 A 7/2013

(Continued)

*Primary Examiner* — John Zimmermann
(74) *Attorney, Agent, or Firm* — Holtz, Holtz & Volek PC

(57) ABSTRACT

A printing apparatus includes a printing head that prints printing data on a printing medium by electric power supplied from a battery, and a processor. The processor is operable to estimate, on the basis of first printing data indicating information on a first printing content to be printed on the printing medium and a remaining battery level of the battery, a first printing executable range which is a range in the first printing content that can be printed on the printing medium, and transmit information indicating the first printing executable range to an external terminal.

6 Claims, 11 Drawing Sheets

(56) References Cited

U.S. PATENT DOCUMENTS

| | | | | |
|---|---|---|---|---|
| 2002/0163569 | A1* | 11/2002 | Shibuya | B41J 29/02 347/172 |
| 2015/0306868 | A1* | 10/2015 | Ohhashi | B41J 29/38 347/5 |

FOREIGN PATENT DOCUMENTS

| | | | |
|---|---|---|---|
| JP | 2016068326 | A | 5/2016 |
| JP | 2017107451 | A | 6/2017 |

* cited by examiner

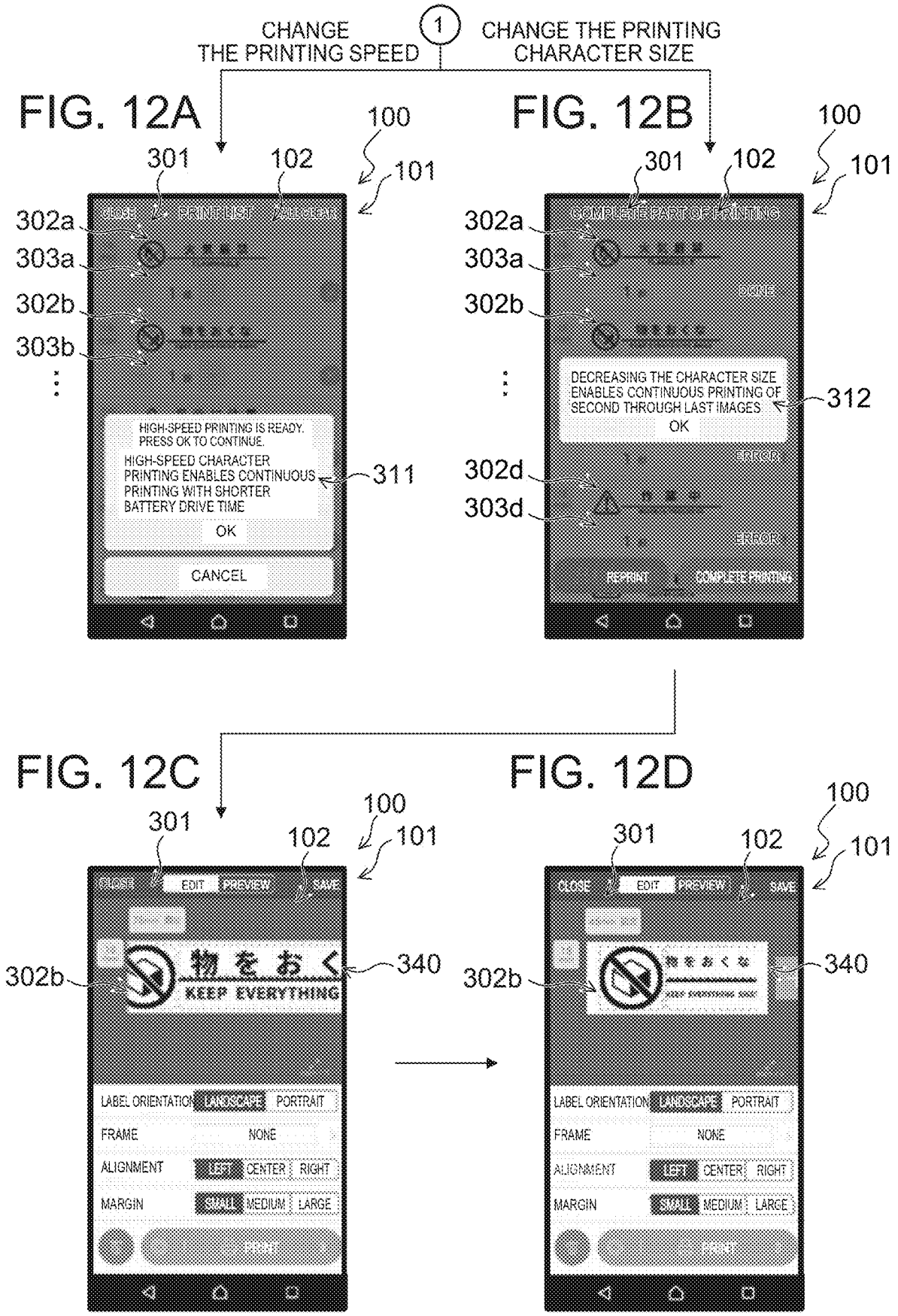
1
CHANGE THE PRINTING SPEED
CHANGE THE PRINTING CHARACTER SIZE
FIG. 12A
FIG. 12B
FIG. 12C
FIG. 12D
100
101
102
301
302a
302b
302d
303a
303b
303d
311
312
340
CLOSE
PRINT LIST
ALL CLEAR
HIGH-SPEED PRINTING IS READY. PRESS OK TO CONTINUE.
HIGH-SPEED CHARACTER PRINTING ENABLES CONTINUOUS PRINTING WITH SHORTER BATTERY DRIVE TIME
OK
CANCEL
COMPLETE PART OF PRINTING
DONE
DECREASING THE CHARACTER SIZE ENABLES CONTINUOUS PRINTING OF SECOND THROUGH LAST IMAGES
ERROR
REPRINT
COMPLETE PRINTING
EDIT
PREVIEW
SAVE
物をおく
KEEP EVERYTHING
LABEL ORIENTATION
LANDSCAPE
PORTRAIT
FRAME
NONE
ALIGNMENT
LEFT
CENTER
RIGHT
MARGIN
SMALL
MEDIUM
LARGE
PRINT

PRINTING APPARATUS, PRINTING CONTROL TERMINAL, PRINTING APPARATUS CONTROLLING METHOD, PRINTING CONTROL TERMINAL CONTROLLING METHOD, AND RECORDING MEDIA

CROSS-REFERENCE TO RELATED APPLICATIONS

This application is based upon and claims the benefit of priority under 35 USC 119 of Japanese Patent Application No. 2017-236303 filed on Dec. 8, 2017, the entire disclosure of which, including the description, claims, drawings, and abstract, is incorporated herein by reference in its entirety.

BACKGROUND OF THE INVENTION

The present application relates to a printing apparatus, a printing control terminal, a method for controlling a printing apparatus, a method for controlling a printing control terminal, and recording media.

DESCRIPTION OF THE RELATED ART

A label printer which is operated from a smartphone or other electronic device connected through wireless or wired communication to print characters or the like on a printing tape to thereby create a printed tape piece (label) with the characters or the like printed thereon is conventionally known.

Japanese Patent Application Laid-Open No. 2013-132803 discloses a label printer having a function of determining a remaining battery level.

However, in a case of performing printing from an electronic device at a place distant from a printing apparatus, even when using the technique disclosed in Japanese Patent Application Laid-Open No. 2013-132803, a user would have to visually check the remaining battery level by approaching the printing apparatus, to determine whether the apparatus is available for printing. Therefore, even if printing is instructed from the electronic device, the designated printing might not be completed if the battery power remaining in the printing apparatus is insufficient. In such a case, printing might be performed only in part, leading to failure in printing and, hence, waste of printing.

BRIEF SUMMARY OF THE INVENTION

The present invention provides a printing apparatus, a printing control terminal, a method for controlling a printing apparatus, a method for controlling a printing control terminal, and recording media which have an advantage of preventing failure in printing due to insufficient battery power remaining in the printing apparatus.

According to an embodiment of the present invention, a printing apparatus includes:

a printing head that prints printing data on a printing medium by electric power supplied from a battery; and a processor, the processor being operable to estimate, on the basis of first printing data indicating information on a first printing content to be printed on the printing medium and a remaining battery level of the battery, a first printing executable range which is a range in the first printing content that can be printed on the printing medium, and transmit information indicating the first printing executable range to an external terminal.

According to an embodiment of the present invention, a printing control terminal includes:

a processor that controls a printing apparatus, the apparatus printing on a printing medium by electric power supplied from a battery;

a display unit; and a communication IF;

the processor being operable to transmit, to the printing apparatus via the communication IF, first printing data indicating information on a first printing content to be printed on the printing medium, receive, from the printing apparatus via the communication IF, information indicating a first printing executable range which is a range in the first printing content that can be printed on the printing medium, the first printing executable range being estimated by the printing apparatus on the basis of the transmitted first printing data and a remaining battery level of the battery, and display the received information indicating the first printing executable range on the display unit.

According to an embodiment of the present invention, there is provided a controlling method of a printing apparatus, the apparatus including a printing head that prints printing data on a printing medium by electric power supplied from a battery and a processor, the method including:

on the basis of first printing data indicating information on a first printing content to be printed on the printing medium and a remaining battery level of the battery, estimating a first printing executable range which is a range in the first printing content that can be printed on the printing medium; and transmitting information indicating the first printing executable range to an external terminal.

According to an embodiment of the present invention, a computer-readable recording medium has recorded thereon a program for causing a computer controlling a printing apparatus, the apparatus including a printing head that prints printing data on a printing medium by electric power supplied from a battery and a processor, to execute processing of:

estimating, by using the processor, on the basis of first printing data indicating information on a first printing content to be printed on the printing medium and a remaining battery level of the battery, a first printing executable range which is a range in the first printing content that can be printed on the printing medium; and transmitting, by using the processor, information indicating the first printing executable range to an external terminal.

According to an embodiment of the present invention, there is provided a controlling method of a printing control terminal, the terminal including a display unit, the method including:

receiving, from a printing apparatus, information indicating a first printing executable range which is a range in a first printing content that can be printed on a printing medium, the first printing executable range being estimated by the printing apparatus on the basis of first printing data indicating information on the first printing content and a remaining battery level of a battery put in the printing apparatus; and displaying the received information indicating the first printing executable range on the display unit.

According to an embodiment of the present invention, a computer-readable recording medium has recorded thereon a program for causing a computer controlling a printing control terminal, the terminal including a display unit, to execute processing of:

receiving, from a printing apparatus, information indicating a first printing executable range which is a range in a first printing content that can be printed on a printing medium, the first printing executable range being estimated by the printing apparatus on the basis of first printing data indicating information on the first printing content and a remaining battery level of a battery put in the printing apparatus; and displaying the received information indicating the first printing executable range on the display unit.

BRIEF DESCRIPTION OF THE SEVERAL VIEWS OF THE DRAWING

FIGS. 12A-12D include display examples in the electronic device in the second embodiment;

DETAILED DESCRIPTION OF THE INVENTION

First Embodiment

Figure 1:
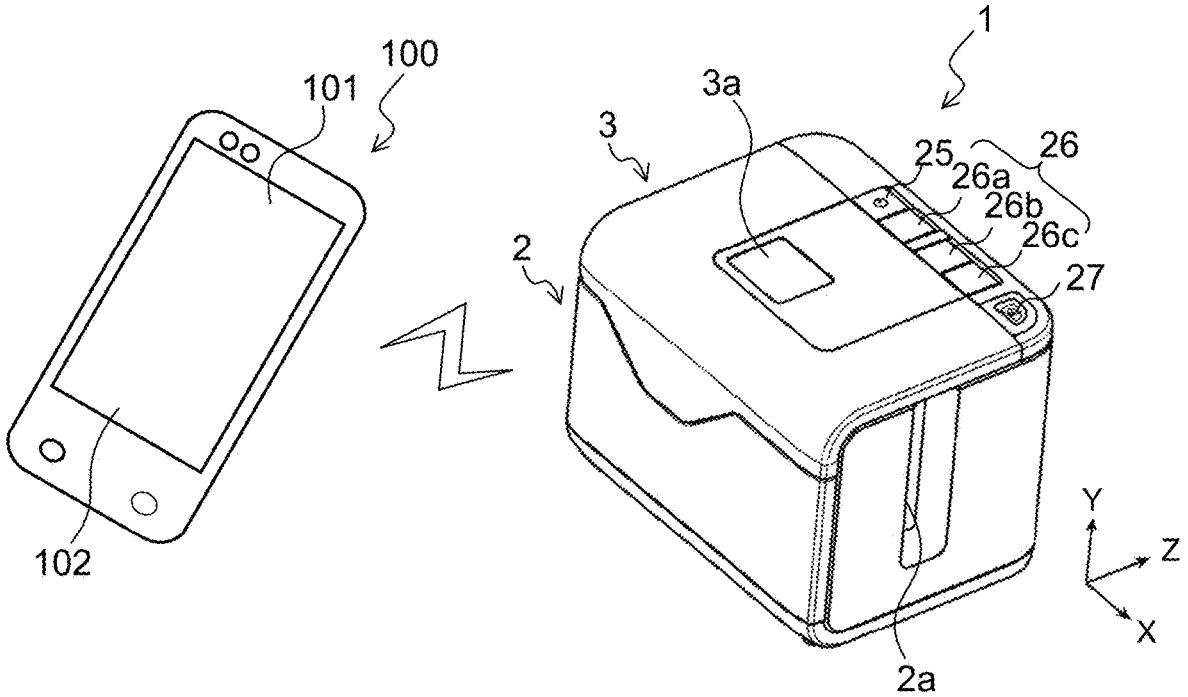
FIG. 1 shows, by way of example, a configuration of a printing system including a printing apparatus according to a first embodiment.
Figure 2:
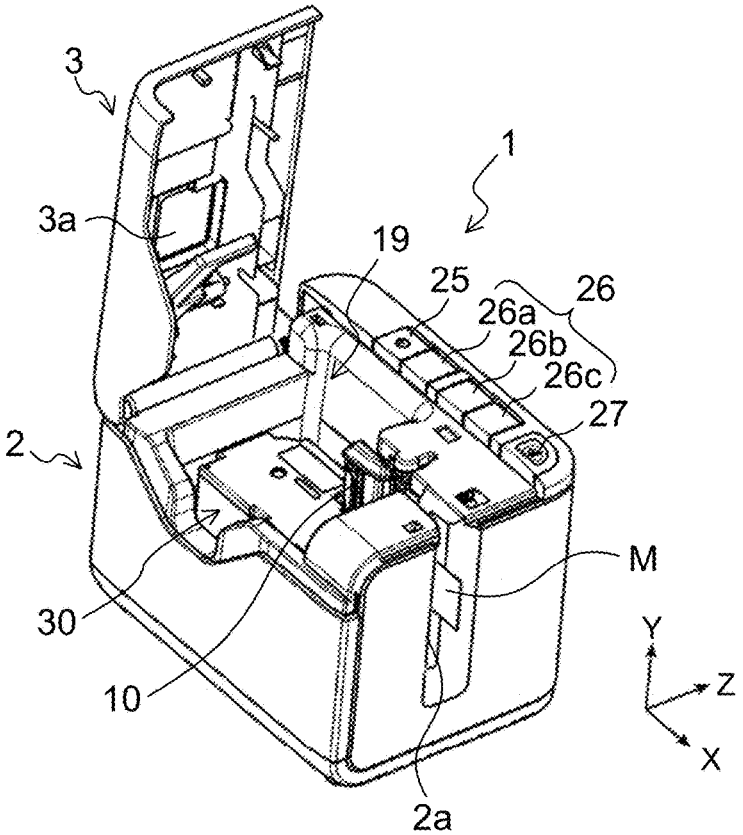
FIG. 2 is a perspective view showing a state where an open/close cover of the printing apparatus is open.

FIG. 1 shows, by way of example, a configuration of a printing system including a printing apparatus according to a first embodiment. FIG. 2 is a perspective view showing a state where an open/close cover 3 of the printing apparatus 1 is open. The printing system shown in FIG. 1 includes the printing apparatus 1, and an electronic device (printing control terminal) 100 which transmits printing data to the printing apparatus 1. The printing apparatus 1 and the electronic device 100 transmit and receive data to and from each other via wireless or wired communication. The printing apparatus 1 is a printing apparatus which prints on a printing medium.

In the first embodiment, the direction in which a printing medium M (printing tape) is conveyed is defined as a "feed direction X", and the width direction of the printing medium M (printing tape) orthogonal to the feed direction X is defined as a "medium width direction Y". The X and Y directions are orthogonal to each other.

Figure 3:
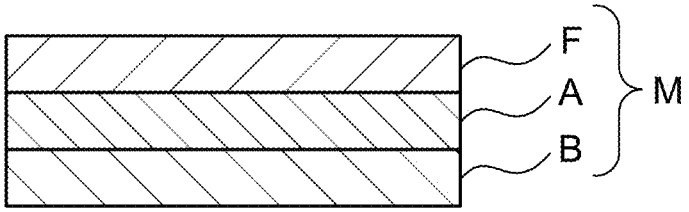
FIG. 3 is a cross-sectional view taken in a medium width direction Y of a printing medium used in the printing apparatus.

The printing apparatus 1 is a printing apparatus which includes a thermal head operative to print on a printing medium. The printing apparatus 1 is, for example, a label printer that prints on the continuous strip printing medium M in single-pass printing. FIG. 3 is a cross-sectional view, observed in the medium width direction Y, of the printing medium M used in the printing apparatus 1. The printing medium M is, for example, an elongated tape member that has a base member B, an adhesive compound A (adhesive surface) applied on the base member B, and release paper F releasably adhered to the base member B through contact with the adhesive compound A. It should be noted that the printing medium M may be an elongated tape member with no release paper F.

As shown in FIGS. 1 and 2, the printing apparatus 1 includes an apparatus chassis 2, and the open/close cover 3 attached to the apparatus chassis 2 in a freely openable manner. As shown in FIG. 2, the apparatus chassis 2 includes a cassette compartment 19 for housing a tape cassette 30 therein. The cassette compartment 19 will be described in detail later.

On the top surface of the apparatus chassis 2, a power button 25, manipulation buttons 26*a*, 26*b*, 26*c* (hereinafter, called the "manipulation button(s) 26") for inputting various manipulations, a cover open button 27 for opening the open/close cover 3, and others are arranged. When a battery D (see FIG. 7) is connected and the power button 25 is depressed in a state where the remaining battery level of the battery D is sufficient, or, in a state where the remaining battery level is not lower than a predetermined threshold level, then a signal is transmitted to a power supply circuit 40 (see FIG. 7), and the printing apparatus 1 is powered ON. In the power ON state, when the power button 25 is depressed again, a signal is transmitted to the power supply circuit 40, and the printing apparatus 1 is powered OFF. When any of the manipulation buttons 26 is depressed, a signal is transmitted to a processor 5 (see FIG. 7), and processing corresponding to that button is performed.

Although not shown in the figure, the apparatus chassis 2 also includes an external device connection terminal, a storage medium insertion slot, and others.

The open/close cover 3 is disposed in an openable/closable manner so as to cover the upper part of the cassette compartment 19.

The open/close cover 3 has a window 3*a* formed for allowing visual confirmation as to whether a tape cassette 30 (see FIG. 4) is housed in the cassette compartment 19 even in the closed state of the open/close cover 3.

The apparatus chassis 2 has a side surface on which a discharge port 2*a* is formed located downstream in the feed direction X of the printing medium M. The printing medium M on which printing has been performed by the thermal head 10 inside the printing apparatus 1 is discharged to the outside from the discharge port 2*a*.

Figure 4:
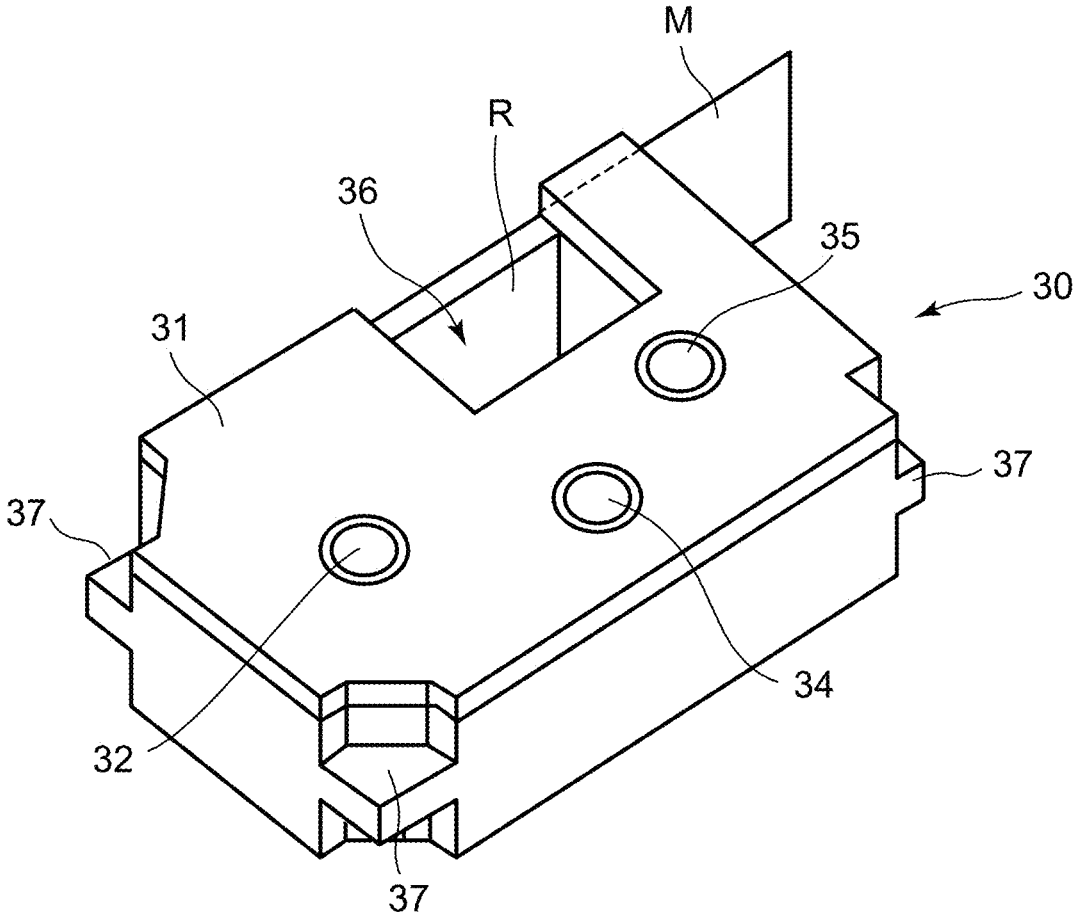
FIG. 4 is a perspective view of a tape cassette housed in the printing apparatus.
Figure 5:
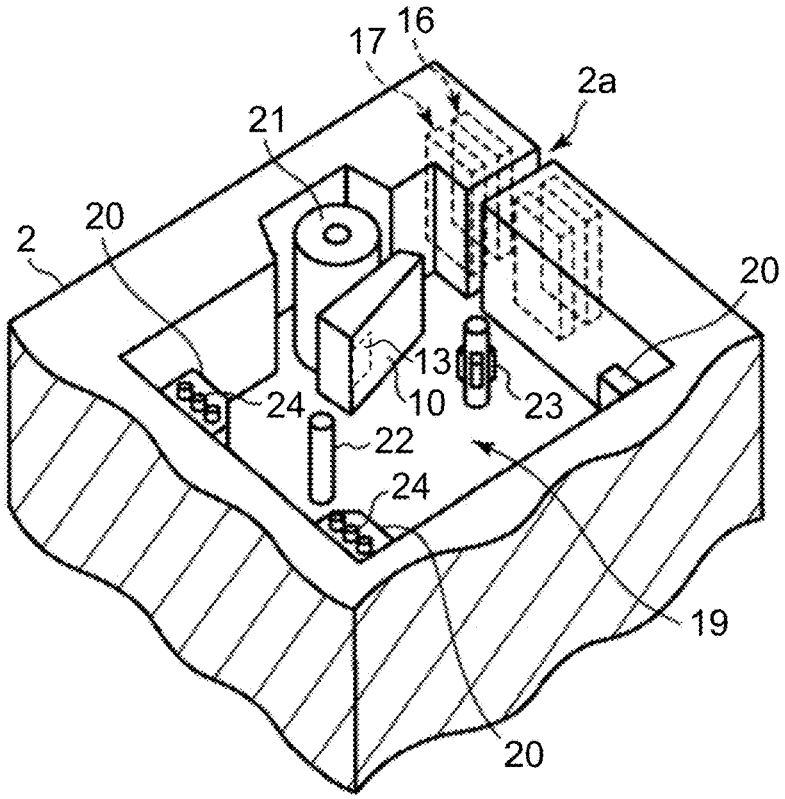
FIG. 5 is a perspective view of a cassette compartment in the printing apparatus.
Figure 6:
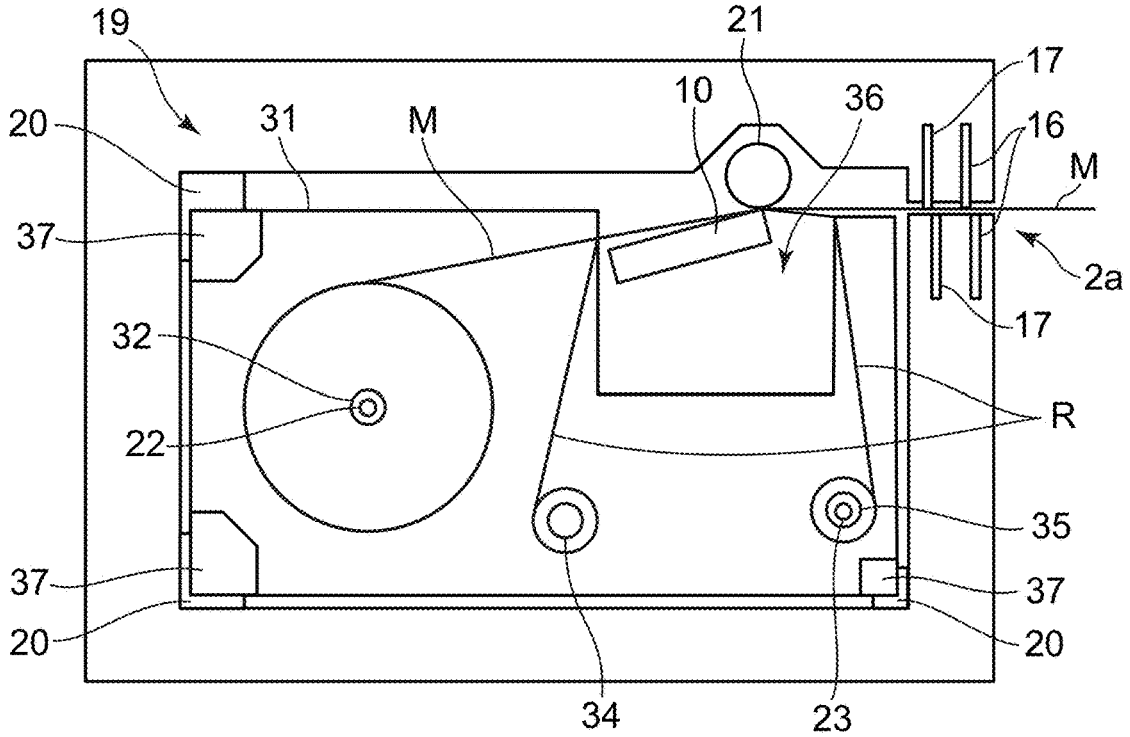
FIG. 6 is a cross-sectional view of the printing apparatus.

FIG. 4 is a perspective view of the tape cassette 30 housed in the printing apparatus 1. FIG. 5 is a perspective view of the cassette compartment 19 in the printing apparatus 1. FIG. 6 is a cross-sectional view of the printing apparatus 1. The tape cassette 30 shown in FIG. 4 is detachably and replaceably housed in the cassette compartment 19 shown in FIG. 5. FIG. 6 shows the state where the tape cassette 30 is housed in the cassette compartment 19.

The tape cassette 30 has, as shown in FIG. 4, a cassette case 31 that has a thermal head insertion section 36 and engagement sections 37 formed therein and stores the printing medium M and an ink ribbon R. The cassette case 31 includes a tape core 32, an ink ribbon supply core 34, and an ink ribbon take-up core 35.

The printing medium M is rolled around the tape core 32 inside the cassette case 31. The ink ribbon R for thermal transfer is rolled around the ink ribbon supply core 34 inside the cassette case 31, with the leading end being wound around the ink ribbon take-up core 35.

The cassette compartment 19 in the apparatus chassis 2 includes a plurality of cassette receiving sections 20 for supporting the tape cassette 30 in a prescribed position, as shown in FIG. 5. The cassette receiving sections 20 are provided with tape width detection switches 24 for detecting the width of the tape (printing medium M) stored in the tape cassette 30.

The tape width detection switch 24 is a switch for detecting the width of the printing medium M (hereinafter, also referred to as "printing tape width") on the basis of the shape of the tape cassette. A plurality of such tape width detection switches 24 are provided in the cassette compartment 19. Tape cassettes having tapes of different printing tape widths are configured to depress different combinations of the tape width detection switches 24. This enables the processor 5 (described later; see FIG. 7) to identify the type of the tape cassette and detect the printing tape width from the combination of the tape width detection switches 24 depressed.

The cassette compartment 19 further includes a thermal head 10 which has a plurality of heating elements and prints on the printing medium M, a platen roller 21 which is a conveyance mechanism for conveying the printing medium M, a tape core engagement shaft 22, and an ink ribbon take-up drive shaft 23. The thermal head 10 further has a thermistor 13 embedded therein. The thermistor 13 is a thermal head temperature measuring unit that measures the temperature of the thermal head 10.

In the state where the tape cassette 30 is housed in the cassette compartment 19, as shown in FIG. 6, the engagement sections 37 provided in the cassette case 31 are supported by the corresponding cassette receiving sections 20 provided in the cassette compartment 19, and the thermal head 10 is inserted in the thermal head insertion section 36 formed in the cassette case 31. The tape core engagement shaft 22 has the tape core 32 engaged therewith, and the ink ribbon take-up drive shaft 23 has the ink ribbon take-up core 35 engaged therewith.

When a printing order is input from the electronic device 100 to the printing apparatus 1, the printing medium M is unreeled from the tape core 32 by rotation of the platen roller 21. At this time, the ink ribbon take-up drive shaft 23 rotates in synchronization with the platen roller 21, so that the ink ribbon R is unreeled from the ink ribbon supply core 34 along with the printing medium M. With this, the printing medium M and the ink ribbon R are conveyed in an overlapping state. As they pass through between the thermal head 10 and the platen roller 21, the ink ribbon R is heated by the thermal head 10, so that the ink is transferred to the printing medium M, whereby printing is performed.

The used ink ribbon R, having passed through between the thermal head 10 and the platen roller 21, is wound up around the ink ribbon take-up core 35. The printed printing medium M, having passed through between the thermal head 10 and the platen roller 21, is cut by a half cutting mechanism 16 or a full cutting mechanism 17 before being discharged from the discharge port 2*a*.

Figure 7:
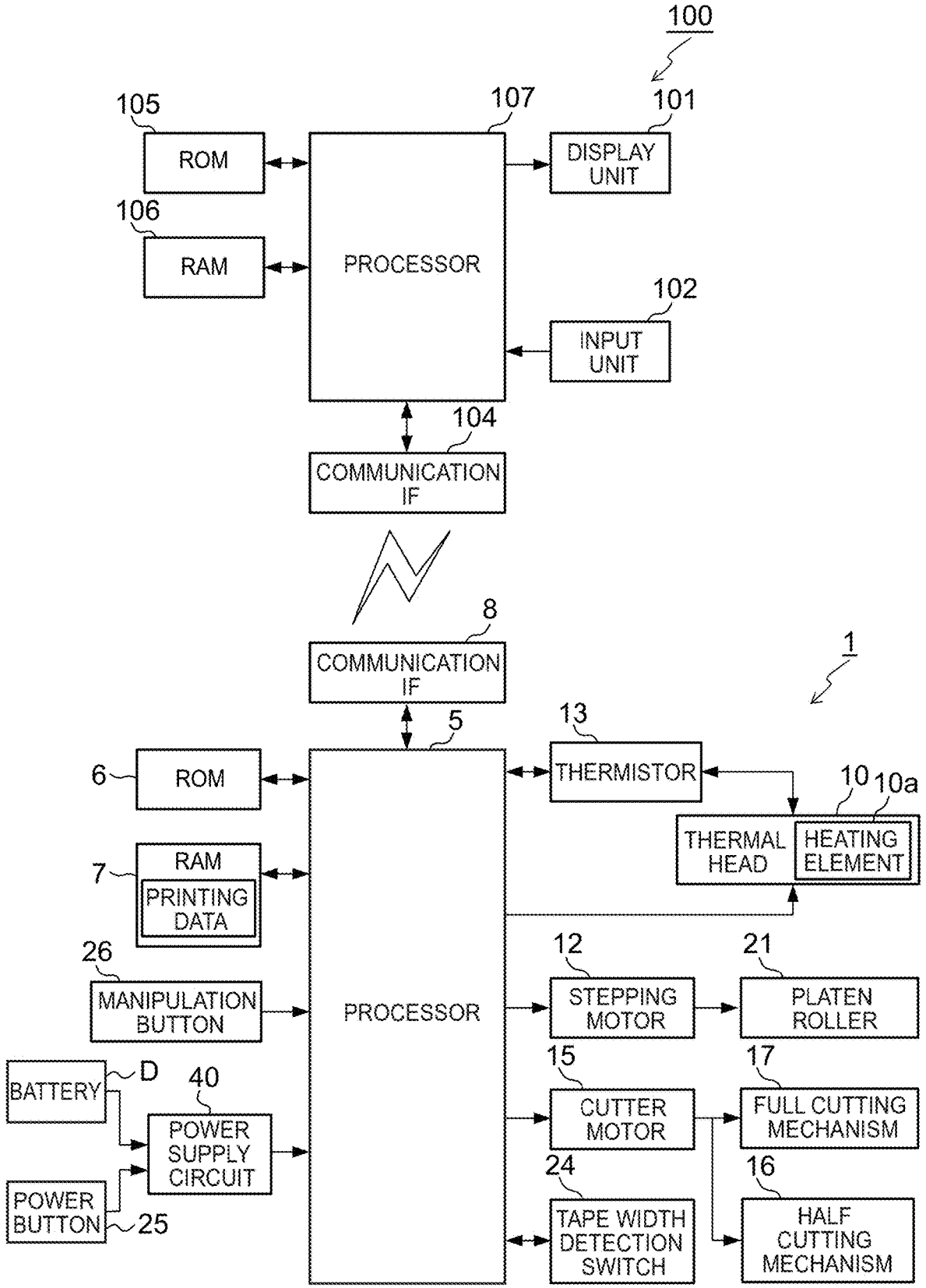
FIG. 7 is a block diagram showing a hardware configuration of the printing apparatus and an electronic device.

FIG. 7 is a block diagram showing a hardware configuration of the printing apparatus 1 and the electronic device 100. As shown in FIG. 7, the printing apparatus 1 includes, in addition to the above-described configuration, the processor 5, a read only memory (ROM) 6, a random access memory (RAM) 7, a communication interface (IF) 8, a stepping motor 12, and a cutter motor 15. Here, at least the processor 5, the ROM 6, and the RAM 7 constitute the computer of the printing apparatus 1.

The processor 5 includes a central processing unit (CPU), for example. The processor 5 extracts programs stored in the ROM 6 on the RAM 7 and executes the programs to control operations of the components in the printing apparatus 1. The communication IF 8 transmits and receives data to and from an external device (such as the electronic device 100) via wired or wireless communication.

The processor 5 controls the motors (stepping motor 12, cutter motor 15).

The processor 5 controls printing by the thermal head 10 on the basis of a plurality of printing modes with different printing speeds. The processor 5 changes electric power supplied to the thermal head 10 in accordance with the printing speed. The printing apparatus 1 has a plurality of (for example, in the first embodiment, three) printing modes. Each printing mode has a printing speed and printing resolution set therefor. The electric power to be supplied to the thermal head 10 is set lower for the printing mode with higher printing speed (with lower printing resolution). The electric power to be supplied to the thermal head 10 is set higher for the printing mode with lower printing speed (with higher printing resolution). That is, the printing apparatus 1 has a plurality of printing modes each having a negative correlation between the printing speed and the electric power supplied to the thermal head 10.

The processor 5 receives, from the electronic device 100, printing data indicating information on a printing content (hereinafter, referred to as "printing data") to be printed on the printing medium M. The received printing data includes information on at least one of printing image data of the printing content, printing density, number of copies, printing tape length, printing tape width, printing speed, printing character size, and the like. The printing image data includes information on dots constituting the printing image data. The printing image data is image data of a printing image including characters and/or graphics to be printed. The printing character size is a size with which the printing image is to be printed on the printing medium M. The printing density is the density with which the printing image is to be printed. The number of copies is the number of copies of the printing image to be printed. The printing tape length is the length of the printing medium M on which the printing image is to be printed. The printing tape width is the width of the printing medium M on which the printing image is to be printed. The printing speed is the speed at which the printing image is to be printed on the printing medium M.

The processor 5 estimates a printing executable range on the printing medium M where printing can be done, on the basis of the received printing data and the remaining battery level of the battery D. Specifically, the processor 5 calculates, on the basis of the printing data, an electric power value to be fed to the thermal head 10, necessary for printing the entire printing content corresponding to the printing data. The processor 5 obtains the remaining battery level of the battery D put in the printing apparatus 1, and calculates the amount of the number of lines or pixels (dots) that can be printed on the basis of the obtained remaining battery level. Then, on the basis of the calculated electric power value to be fed to the thermal head 10 and the calculated amount of the number of lines or pixels (dots) that can be printed, the processor 5 estimates the printing executable range, and evaluates the estimation result. For calculating the amount of the number of lines or pixels (dots) that can be printed on the basis of the remaining battery level and for calculating the electric power value to be fed to the thermal head 10 that is necessary for printing the entire printing content, any known techniques can be adopted, so a description thereof will not be provided here. On the basis of the estimation result, the processor 5 transmits, to the electronic device 100, information on the printing executable range which is necessary for the printing executable range to be displayed in the electronic device 100. The information may be one of the amount of the number of lines, the amount of the number of pixels (dots), and printing image data to be printed in accordance with the remaining battery level.

The ROM 6 stores a printing program for performing printing on the printing medium M, and various data (for example, fonts etc.) necessary for executing the printing program. The ROM 6 also functions as a storage medium that stores a program readable by the processor 5. The ROM 6 is constituted by a flash memory capable of retaining data even when the power is OFF. While the power is OFF, the ROM 6 can also temporarily store the lastly set printing mode. The RAM 7 includes a printing data storage unit which stores printing data. The RAM 7 includes a display data storage unit which stores display data. The communication IF 8 transmits and receives printing data and others to and from an external device (such as the electronic device 100) or a storage device in an external server via wired or wireless communication.

The thermal head 10 is a printing head having a plurality of heating elements 10*a* arranged in a main scanning direction. An electric current is caused to flow through the heating elements 10*a* selectively in accordance with the printing data output from the processor 5, so that the selected one(s) of the heating elements 10*a* generate(s) heat and apply(ies) the heat to the ink ribbon R. In this manner, the thermal head 10 performs thermal transfer printing on the printing medium M one line at a time.

The processor 5 drives the stepping motor 12. The stepping motor 12 rotates the platen roller 21. The platen roller 21 is a conveyance mechanism which rotates with the power supplied from the stepping motor 12 to convey the printing medium M in a longitudinal direction (sub-scanning direction, feed direction) of the printing medium M.

Further, the processor 5 drives the cutter motor 15. The half cutting mechanism 16 and the full cutting mechanism 17 operate with the power supplied from the cutter motor 15 to half cut or full cut the printing medium M. Here, half cutting refers to an operation of cutting only the base member B of the printing medium M in the width direction. Full cutting refers to an operation of cutting the base member B together with the release paper F in the width direction.

The power supply circuit 40 is a power supply unit which generates output voltage from direct current voltage from the battery D, and supplies electric power to the components of the printing apparatus 1.

As shown in FIGS. 1 and 7, the electronic device 100 is a portable computer such as a smartphone, tablet terminal, or the like, which includes a display unit 101 and an input unit 102. The display unit 101 may be a liquid crystal display or an organic electroluminescence (organic EL) display, for example. The input unit 102 is a touch panel, for example.

The electronic device 100 includes, in addition to the above-described configuration, a communication interface (IF) 104, a ROM 105, a RAM 106, and a processor 107. The processor 107 is a computing unit, which executes an application program to display a message transmitted from the printing apparatus 1 on the display unit 101, and accept a user touch manipulation made on the input unit 102.

The processor 107, in response to the user touch manipulation on the input unit 102, accepts printing image data as well as information on at least one of printing density, number of copies, printing tape length, printing tape width, printing speed, printing character size and the like for the printing image data, as printing data (first printing data) indicating information on the printing content (first printing content) to be printed on the printing medium M. The processor 107 transmits the printing data to the printing apparatus 1.

The processor 107 receives, from the printing apparatus 1, information on the printing executable range (first printing executable range) in the printing medium M, as the limit (printing executable limit) within which printing is executable on the printing medium M, which is calculated on the basis of the transmitted printing data and the remaining battery level of the battery D.

The processor 107, on the basis of the information on the printing executable range received from the printing apparatus 1, displays the printing executable range on the display unit 101. The processor 107 displays the printing executable range in the printing medium M and a printing inexecutable range in the printing medium M in a distinguishable manner on the basis of two types of areas which have been set, for example, to have different transmittance levels from each other. For example, the printing executable range is displayed on the display unit 101 with a high, first transmittance level, and the printing inexecutable range is displayed with a second transmittance level which is lower than the first transmittance level. The printing executable range is displayed in units of pixels (dots) or in units of lines in the sub-scanning direction of the printing medium M. An exemplary display of the printing executable range in the printing medium M will be described later.

It should be noted, when the processor 107 receives information on the printing executable range from the printing apparatus 1 and thereafter further accepts a modification to the printing data, the processor 107 transmits printing data (second printing data) indicating information on the modified printing content (second printing content) again to the printing apparatus 1. In this case, the processor 107 receives, from the printing apparatus 1, information on a printing executable range (second printing executable range) calculated on the basis of the printing data re-transmitted to the printing apparatus 1 and the remaining battery level of the battery D. Then, on the basis of the information on the printing executable range newly received from the printing apparatus 1, the processor 107 displays the printing executable range in the printing medium M again on the display unit 101.

Figure 8A:
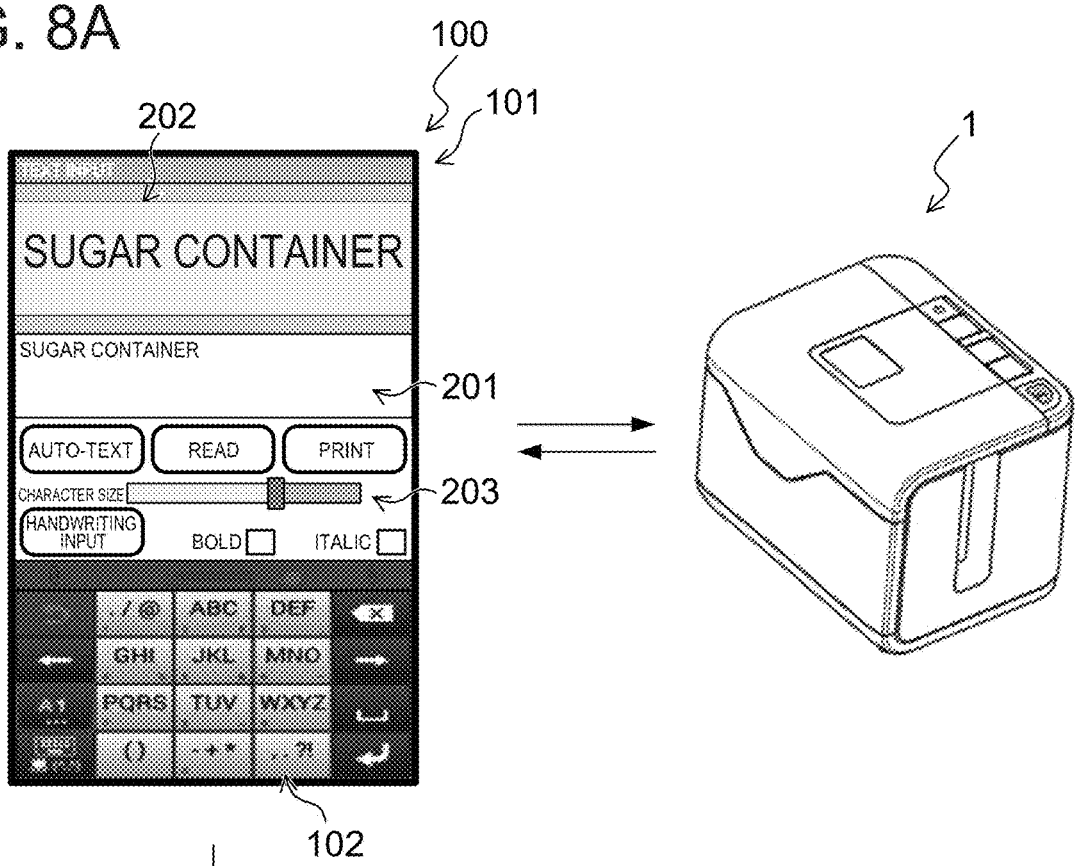
FIGS. 8A and 8B include display examples in the electronic device in the first embodiment.
Figure 8B:
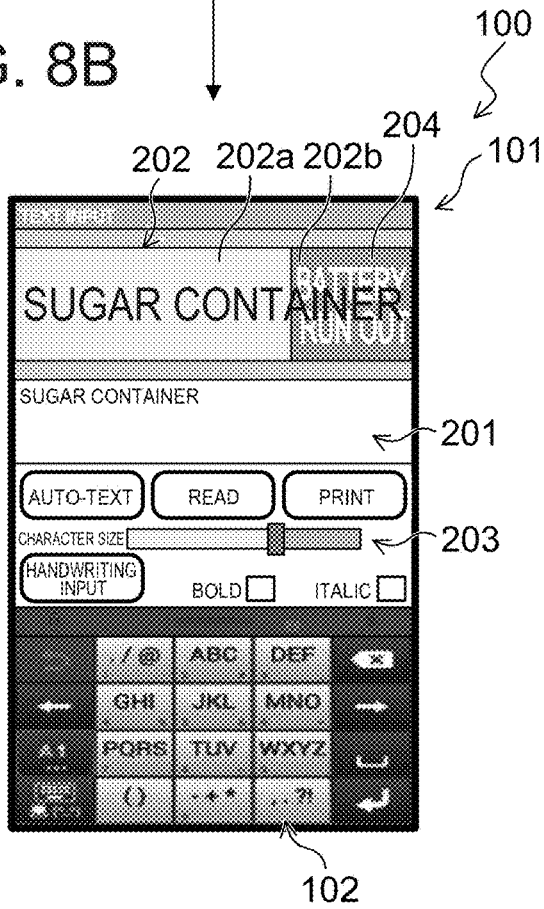

A summary of display control processing carried out in the electronic device 100 in the first embodiment will now be described with reference to FIGS. 8A and 8B. FIGS. 8A and 8B include display examples in the electronic device 100 in the first embodiment.

For example, as shown in FIG. 8A, when the user inputs characters in an input area 201 on the display unit 101 using the input unit 102, the processor 107 creates printing image data on the basis of the input characters. In the example in FIG. 8A, the processor 107 creates printing image data of "SUGAR CONTAINER" on the basis of the characters "sugar container" input in the input area 201. The processor 107 then displays a printing image "SUGAR CONTAINER"

based on the created printing image data, in a print display area 202 on the display unit 101. When the user manipulates, using the input unit 102, a slide bar in a character size manipulation area 203 on the display unit 101 to set the character size, the processor 107 adjusts and creates printing image data on the basis of the set character size, and displays a printing image of the created printing image data in the print display area 202 on the display unit 101.

Although not shown in the figure, the user may also set the information on printing density, number of copies, printing tape length, printing tape width, printing speed, and the like arbitrarily by manipulating the same using the input unit 102, in a similar manner as the information on the character size shown in FIG. 8A. In such a case, the processor 107 adjusts and creates printing image data on the basis of the set information on the printing density, number of copies, printing tape length, printing tape width, printing speed, and the like, and displays the printing image of the created printing image data in the print display area 202 on the display unit 101.

Thereafter, the processor 107 accepts printing data including the information on the printing image data adjusted and created on the basis of the information on the printing density, number of copies, printing tape length, printing tape width, printing speed, and the like, and transmits the printing data to the printing apparatus 1.

The printing apparatus 1 estimates the printing executable range in which printing can be done on the printing medium M, on the basis of the received printing data and the remaining battery level of the battery D. In the example in FIGS. 8A and 8B, it is assumed that the result of calculation by the printing apparatus 1 indicates, as the information on the printing executable range, that a part "SUGAR CONTA" out of the printing content "SUGAR CONTAINER" included in the printing data falls within the printing executable range. An exemplary way for the printing apparatus 1 to estimate the printing executable range will be described later.

As a result of calculation by the printing apparatus 1, when only a part of the printing data can be printed with the current remaining battery level, or, when the characters "SUGAR CONTA" out of the printing content "SUGAR CONTAINER" included in the printing data fall within the printing executable range and the characters "INER" fall outside the printing executable range, the information on the printing executable range together with information on an error notification is transmitted from the printing apparatus 1 to the electronic device 100. The information on the printing executable range may include information in units of pixels (dots) in the printing executable range, or information in units of lines in the sub-scanning direction of the printing medium M.

When receiving the error notification from the printing apparatus 1, the processor 107 displays the printing executable range in the printing medium M. Specifically, as shown in FIG. 8B, on the basis of the information on the printing executable range, the processor 107 displays the printing executable range 202*a* indicating a range where printing can be done and the printing inexecutable range 202*b* indicating a range where printing cannot be done, for the printing data being displayed in the print display area 202 on the display unit 101. In FIG. 8B, the processor 107 displays "SUGAR CONTA" in the printing executable range 202*a* and "INER" in the printing inexecutable range 202*b* out of the printing content "SUGAR CONTAINER" included in the printing data. In the case where the information on the printing executable range includes information in units of pixels (dots) in the printing executable range, the processor 107 displays the printing executable range 202*a* and the printing inexecutable range 202*b* distinguishably in units of pixels. In the case where the information on the printing executable range includes information in units of lines in the sub-scanning direction of the printing medium M, the processor 107 displays the printing executable range 202*a* and the printing inexecutable range 202*b* distinguishably in units of lines in the sub-scanning direction in the printing medium M.

In the example in FIG. 8B, the processor 107 displays the printing executable range 202*a* indicating the range where printing can be done, with the high, first transmittance level, and displays the printing inexecutable range 202*b* indicating the range where printing cannot be done, with the second transmittance level lower than the first transmittance level, thereby displaying the two ranges in the distinguishable manner.

When the processor 107 receives the error notification, the processor 107 may also display a message 204 indicating that there is the range that cannot be printed, in the print display area 202. In the first embodiment, the processor 107 displays a warning reading: "BATTERY RUN OUT" as the message 204, although not limited thereto, any content allowing the user to understand that there is the range that cannot be printed due to insufficient battery level remaining can be displayed.

When the user who has confirmed that there is the range that cannot be printed (printing inexecutable range 202*b*) uses the input unit 102 to manipulate the slide bar in the character size manipulation area 203, for example, the processor 107 re-creates printing image data on the basis of the manipulated character size.

Although not shown in the figure, when the user uses the input unit 102 to manipulate the information on printing density, number of copies, printing tape length, printing tape width, printing speed, or the like arbitrarily, in the similar manner as the information on the character size shown in FIG. 8B, the processor 107 re-creates printing image data on the basis of the manipulated printing density, number of copies, printing tape length, printing tape width, printing speed, or the like. The processor 107 then re-transmits the information including the re-created printing image data, printing density, number of copies, printing tape length, printing tape width, printing speed, and the like, as printing data, to the printing apparatus 1.

The printing apparatus 1 re-calculates a printing executable range in which printing can be done on the printing medium M, on the basis of the re-transmitted printing data and the remaining battery level. If the calculation result shows that only a part of the printing data can be printed with the current remaining battery level, information on the printing executable range together with information on an error notification is re-transmitted from the printing apparatus 1 to the electronic device 100.

The user can change the printing character size, printing density, number of copies, printing tape length, printing tape width, printing speed, or the like repeatedly until such changes of the printing character size or the like yield the state where there comes no error notification from the printing apparatus 1 and there exists no printing inexecutable range, and thus, the desired printing can be done without fail. When the entire printing content is included in the printing executable range, the processor 5 controls the thermal head 10 to print the printing content on the printing medium M.

While the printing executable range 202*a* is displayed with the higher transmittance level and the printing inexecutable range 202*b* is displayed with the lower transmittance level in the first embodiment, the display manner is not limited thereto. All that is needed is that the printing executable range 202*a* and the printing inexecutable range 202*b* are displayed in such a manner that the user can visually distinguish them. For example, the two ranges can be displayed with different colors, different patterns, different brightness, or different shading.

Figure 9:
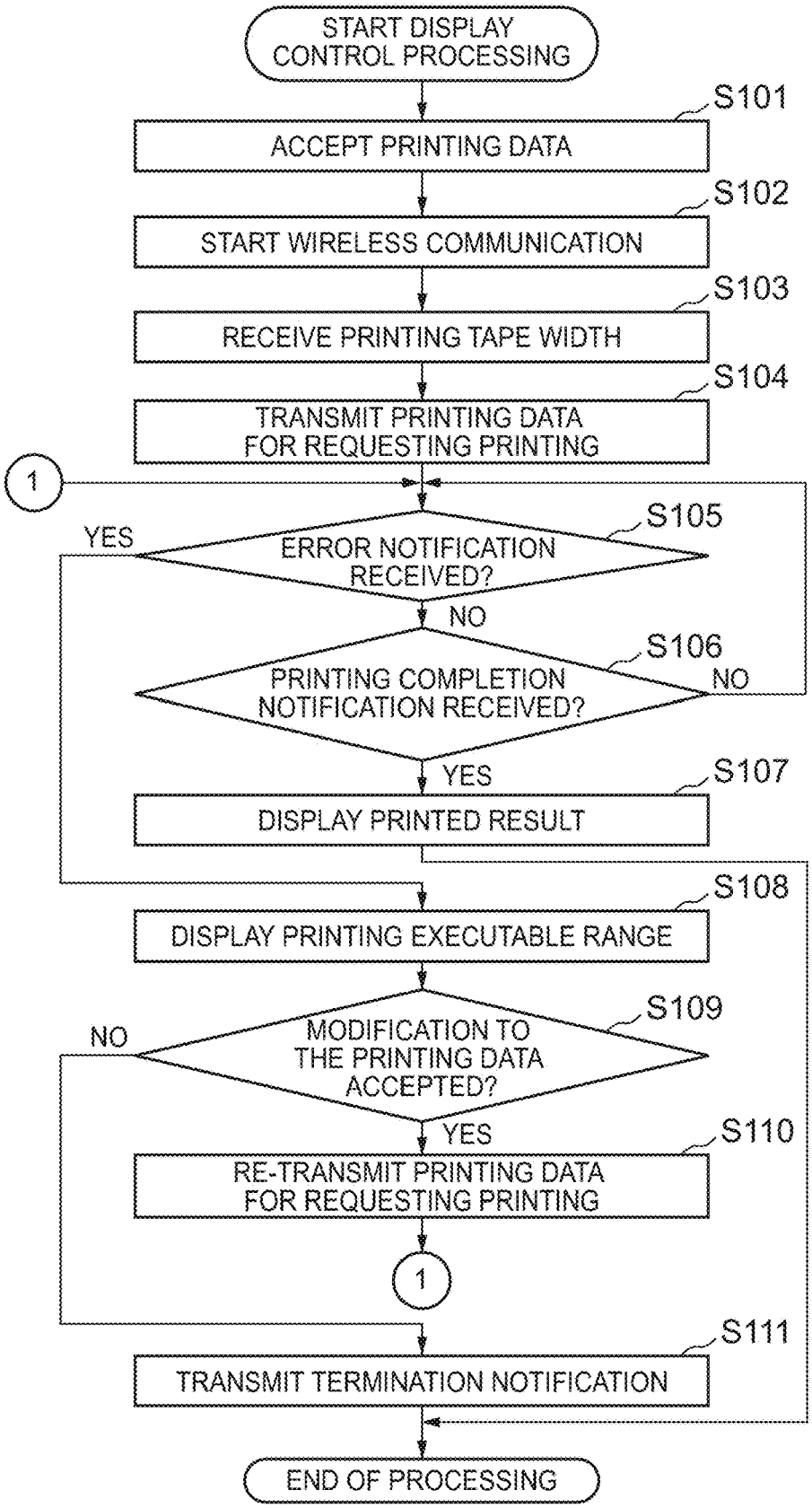
FIG. 9 is a flowchart illustrating display control processing in the electronic device in the first embodiment.

Display control processing performed by the electronic device 100 in the first embodiment will now be described with reference to FIG. 9. FIG. 9 is a flowchart illustrating the display control processing of the electronic device 100 in the first embodiment. In the display control processing of the electronic device 100 in the first embodiment, processing of displaying the printing executable range in the printing medium M, which is calculated on the basis of the remaining battery level of the battery D in the printing apparatus 1 and transmitted from the printing apparatus 1, is carried out.

The electronic device 100 starts the display control processing shown in FIG. 9 in accordance with an order to start printing. In the display control processing, the processor 107 executes an application program of the electronic device 100 to accept the user manipulation of inputting characters and the like through the input unit 102, and create printing image data. The processor 107 accepts, through the input unit 102, character size, printing density, number of copies, printing tape length, printing tape width, printing speed, and the like for the created printing image data. The processor 107 accepts information including printing image data adjusted and created on the basis of the information on the character size, printing density, number of copies, printing tape length, printing tape width, printing speed, and the like, as printing data (step S101). The processor 107 stores the accepted printing data in the RAM 106.

The processor 107 starts wireless communication with the printing apparatus 1 (step S102), to attain a state capable of transmitting and receiving printing data and others to and from the printing apparatus 1. The processor 107 receives information on the printing tape width of the printing medium M put in the printing apparatus 1, transmitted from the printing apparatus 1 (step S103). The processor 107 transmits printing data including information on the printing tape width and printing tape length for requesting printing this time, to the printing apparatus 1 (step S104).

The printing apparatus 1 estimates the printing executable range in which printing can be done on the printing medium M, on the basis of the printing data transmitted in the step S104 and the remaining battery level of the battery D. In the case where the printing apparatus 1 determines, on the basis of the calculation result, that only a part of the printing data can be printed with the current remaining battery level, the printing apparatus 1 transmits to the electronic device 100 information on the printing executable range in the printing medium M, necessary for the printing executable range to be displayed, together with information on an error notification. An exemplary way of estimating the printing executable range in the printing medium M in the printing apparatus 1 will be described later.

The processor 107 receives, from the printing apparatus 1, information on the printing executable range that has been calculated in the printing apparatus 1 on the basis of the printing data transmitted in the step S104 and the remaining battery level. In the case where the current remaining battery level is insufficient to print the entire printing content on the printing medium M, the information on the printing executable range together with the information on the error notification is transmitted from the printing apparatus 1, so the processor 107 in the electronic device 100 receives the information.

The processor 107 determines whether the error notification has been received (step S105). If no error notification has been received (NO in step S105), the processor 107 determines whether a printing completion notification transmitted from the printing apparatus 1 has been received (step S106). The printing completion notification is a notification transmitted when printing has been completed, or, printing has been finished with no problem in the printing apparatus 1 in printing control processing which will be described later. If no printing completion notification has been received (NO in step S106), the process returns to step S105, and the processes in the steps S105 and S106 are repeated. That is, while neither the error notification nor the printing completion notification is being received, the printing apparatus 1 must be calculating the printing executable range or performing printing, so the display control processing is placed in a standby mode during the time.

When the printing completion notification is received (YES in step S106), the processor 107 displays the printed result on the display unit 101 (step S107). For example, the processor 107 displays, as the printed result, information allowing the user to understand that the printing has been finished with no problem, for example "printing complete" or the like, on the display unit 101. With this process done, the display control processing is completed.

On the other hand, if the error notification is received (YES in step S105), the processor 107 displays, on the display unit 101, the printing executable range in the printing medium M, on the basis of the information on the printing executable range transmitted from the printing apparatus 1 (step S108).

The processor 107 determines whether the modification to the printing data by the user has been accepted through the input unit 102 (step S109). If no modification to the printing data by the user has been accepted (NO in step S109), the processor 107 transmits the termination notification, notifying that the processing is terminated without printing, to the printing apparatus 1 (step S111), and the display control processing is terminated.

On the other hand, in the state where the printing inexecutable range 202*b* is being displayed as shown in FIG. 8B, when the user manipulates information on the printing character size, printing density, number of copies, printing tape length, printing tape width, printing speed, or the like arbitrarily through the input unit 102, then the processor 107 determines that the modification to the printing data by the user has been accepted (YES in step S109). In this case, the processor 107 re-creates printing image data on the basis of information on the manipulated printing character size, printing density, number of copies, printing tape length, printing tape width, printing speed, or the like. The processor 107 then accepts information including the re-created printing image data, printing density, number of copies, printing tape length, printing tape width, printing speed, and the like, as printing data, and re-transmits the accepted data to the printing apparatus 1 as the printing data for requesting printing (step S110).

The printing apparatus 1 re-estimates the printing executable range in which printing can be done on the printing medium M, on the basis of the printing data re-transmitted in the step S110 and the remaining battery level. Then, on the basis of the calculation result, the printing apparatus 1 re-transmits information on the printing executable range, necessary for display of the printing executable range, to the electronic device 100. An exemplary way for the printing apparatus 1 to re-transmit the information on the printing executable range to the electronic device 100 will be described later.

The process then proceeds to step S105 again, where the processor 107 determines again whether the error notification has been received. That is, the display control processing is repeatedly carried out until it becomes possible to print the entire printing image as the user has changed any of the printing character size, printing density, number of copies, printing tape length, printing tape width, printing speed, and the like and, thus, there comes no error notification and there exists no printing inexecutable range, or until the user ceases modifying the printing data.

Figure 10:
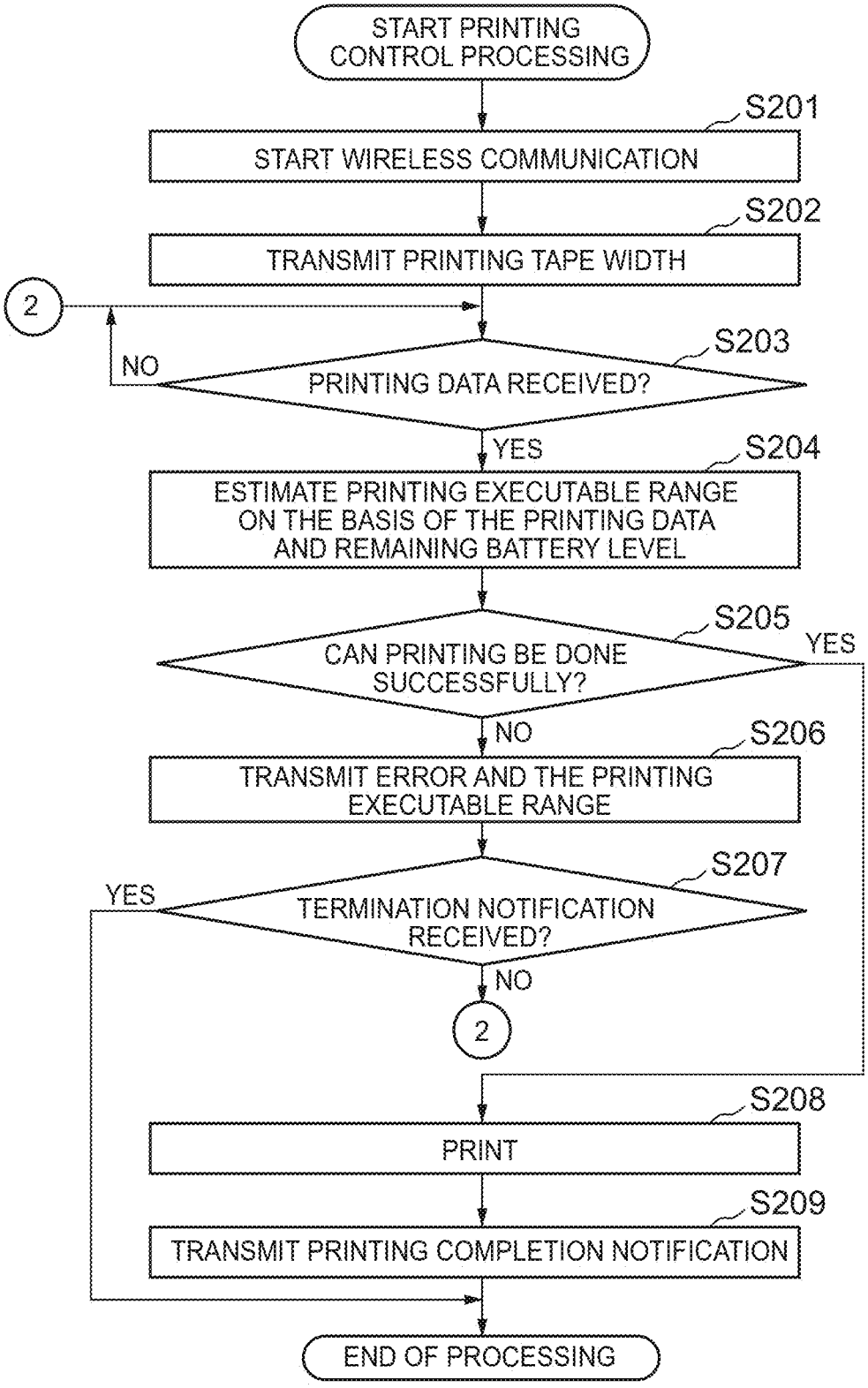
FIG. 10 is a flowchart illustrating printing control processing in the printing apparatus in the first embodiment.

Printing control processing performed by the printing apparatus 1 in the first embodiment will now be described with reference to FIG. 10. FIG. 10 is a flowchart illustrating the printing control processing of the printing apparatus 1 in the first embodiment. In the printing control processing of the printing apparatus 1 in the first embodiment, the printing executable range in which printing can be done on the printing medium M is estimated on the basis of printing data transmitted from the electronic device 100 and the remaining battery level of the battery D. Then, on the basis of the calculation result, processing of transmitting to the electronic device 100 information on the printing executable range, necessary for the printing executable range to be displayed in the electronic device 100, is performed.

The printing apparatus 1 starts the printing control processing shown in FIG. 10 in accordance with the order to start printing. In the printing control processing, the processor 5 starts wireless communication with the electronic device 100 (step S201), to attain the state capable of transmitting and receiving printing data and others to and from the electronic device 100. The processor 5 transmits information on the printing tape width of the printing medium M put in the printing apparatus 1, to the electronic device 100 (step S202).

The processor 5 determines whether printing data transmitted from the electronic device 100 has been received (step S203). If printing data has not been received (NO in step S203), the step S203 is repeated until the printing data is received, with the printing control processing placed in the standby mode.

On the other hand, when the printing data is received (YES in step S203), the processor 5 estimates the printing executable range on the basis of the received printing data and the remaining battery level of the battery D in the printing apparatus 1 (step S204). In this process, for example, the processor 5 calculates the electric power value to be fed to the thermal head 10 that is necessary for printing on the basis of the printing data. The processor 5 obtains the remaining battery level, and calculates the amount of the number of lines or pixels (dots) that can be printed, on the basis of the remaining battery level obtained. The processor 5 then estimates the printing executable range on the basis of the electric power value necessary to be fed to the thermal head 10 for printing, and the amount of the number of lines or pixels (dots) that can be printed based on the remaining battery level.

As a result of calculation in the step S204, if it is determined that the printing will not be able to be done successfully, for example when it is determined that only a part of the printing data can be printed in consideration of the printing executable range based on the current remaining battery level (NO in step S205), the processor 5 transmits information on the printing executable range together with information on the error notification to the electronic device 100 (step S206). Thereafter, when the termination notification transmitted from the electronic device 100 (in step S111 in the display control processing in FIG. 9) has been received (YES in step S207), the printing control processing is terminated without performing printing.

On the other hand, if no termination notification has been received (NO in step S207), the process returns to step S203. In this case, printing data should be re-transmitted from the electronic device 100 (in step S110 in the display control processing in FIG. 9), so when the printing data re-transmitted from the electronic device 100 is received (YES in step S203), the printing executable range is re-estimated on the basis of the re-transmitted printing data and the remaining battery level (step S204). That is, the printing control processing is repeatedly carried out until it is determined that the printing can be done successfully (YES in step S205), or until the termination notification is received (YES in step S207).

If it is determined that the printing can be done successfully (YES in step S205), the processor 5 performs printing on the basis of the received printing data (step S208), and transmits the printing completion notification to the electronic device 100 (step S209). With this process done, the printing control processing is completed.

In the first embodiment, the printing executable range from within a length of the printing medium M necessary for printing a piece of label, calculated on the basis of a single piece of the printing data and the remaining battery level of the battery D in the printing apparatus 1, transmitted from the printing apparatus 1, is displayed on the display unit 101. However, the present embodiment is not limited thereto. For example, in the case where the user wishes to print a plurality of copies continuously on the basis of a single piece of printing data, the processor 107 may display the printing executable range and the printing inexecutable range from within a length of the printing medium M necessary for printing the desired number of labels.

In the first embodiment, the printing executable range in the printing medium M is displayed on the display unit 101 as the limit (printing executable limit) within which printing is executable on the printing medium M on the basis of the remaining battery level of the battery D in the printing apparatus 1. This allows the user who has seen the display screen to recognize the range that can be printed. This prevents failure in printing and, hence, waste of printing due to the printing only partially done.

Further, it may be configured such that the user who has seen the printing executable range can change any of the printing character size, printing density, number of copies, printing tape length, printing tape width, printing speed, and the like, so that the desired printing can be completed within the remaining battery level of the battery D in the printing apparatus 1. With this, even in the case where the battery level remaining in the printing apparatus 1 is insufficient, the printing can be continued under the conditions permitted by the user, so the failure in printing due to insufficient battery level remaining can be avoided.

Further, the printing executable range 202*a* indicating the range where printing can be done and the printing inexecutable range 202*b* indicating the range where printing cannot be done are displayed in the distinguishable manner using transmittance levels different from each other. This allows the user to recognize, at a glance, that it is not possible to complete printing.

Furthermore, the printing executable range is displayed in units of pixels (dots) or in units of lines in the sub-scanning direction of the printing medium M. This allows the user to clearly distinctively understand the printing executable range and the printing inexecutable range.

Second Embodiment

A second embodiment will now be described. The hardware configurations of the printing apparatus 1 and the electronic device 100 according to the second embodiment are identical to those in the first embodiment, so the description thereof will not be repeated. In the first embodiment, processing of estimating the printing executable range in which printing can be done on the printing medium M on the basis of printing data transmitted from the electronic device 100 and the remaining battery level of the battery D in the printing apparatus 1 was performed.

In this regard, in the second embodiment, the printing data includes information on the number of pieces of labels that are to be formed by printing on the printing medium M by the thermal head 10, and the information indicating the printing executable range includes information on the number of labels (hereinafter, referred to as "number of printable labels") that can be printed by the thermal head 10. Therefore, the second embodiment differs from the first embodiment in that the number of printable labels on the printing medium M, calculated on the basis of the remaining battery level, is estimated.

The processor 5 in the second embodiment estimates, on the basis of printing data received from the electronic device 100 and the remaining battery level of the battery D, the number of printable labels that can be printed on the printing medium M, or, the number of pieces of labels that can be formed by printing on the printing medium M by the thermal head 10. Specifically, the processor 5 calculates the electric power value to be fed to the thermal head 10, necessary for printing the entire printing content corresponding to the printing data, on the basis of the printing data. The processor 5 obtains the remaining battery level, and calculates the amount of the number of lines or pixels (dots) that can be printed on the basis of the obtained remaining battery level. The processor 5 then estimates the number of printable labels, on the basis of the calculated electric power value to be fed to the thermal head 10 and the calculated amount of the number of lines or pixels (dots) that can be printed, and evaluates the estimation result. On the basis of the estimation result, the processor 5 transmits information on the number of printable labels, necessary for the number of printable labels to be displayed on the electronic device 100, to the electronic device 100.

The RAM 106 in the second embodiment has set therein a layout memory area for continuous printing. The layout memory area stores a plurality of pieces of printing image data for continuous printing, and information on a printing tape width in the printing image data.

A summary of display control processing performed by the electronic device 100 in the second embodiment will be described with reference to FIGS. 11 and 12. FIGS. 11 and 12 illustrate display examples in the electronic device 100 in the second embodiment.

Figure 11A:
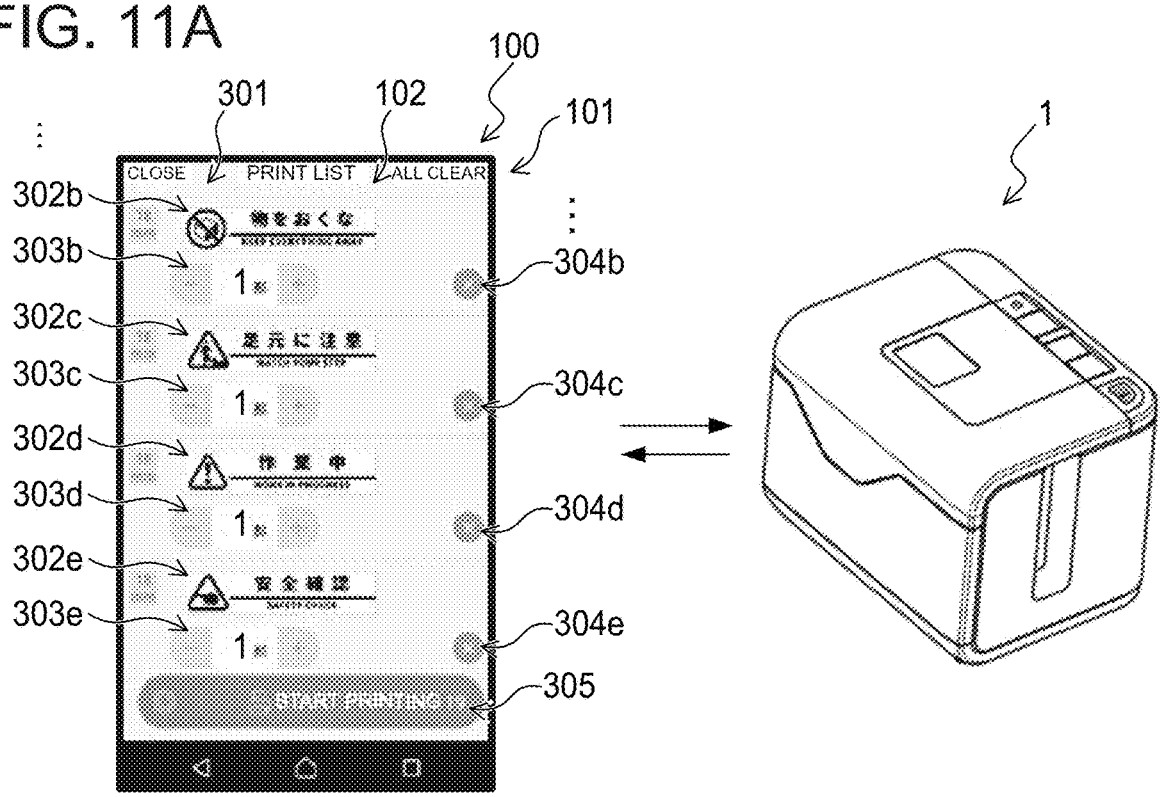
FIGS. 11A and 11B include display examples in the electronic device in a second embodiment.

In a continuous printing image display area 301 on the display unit 101 shown in FIG. 11A, a plurality of printing images 302*b* to 302*e*, the number of copies (labels) 303*b* to 303*e* selected for the respective printing images 302*b* to 302*e*, cancel buttons 304*b* to 304*e* for the respective printing images 302*b* to 302*e*, and a print start button 305 for performing printing are displayed.

Figure 11B:
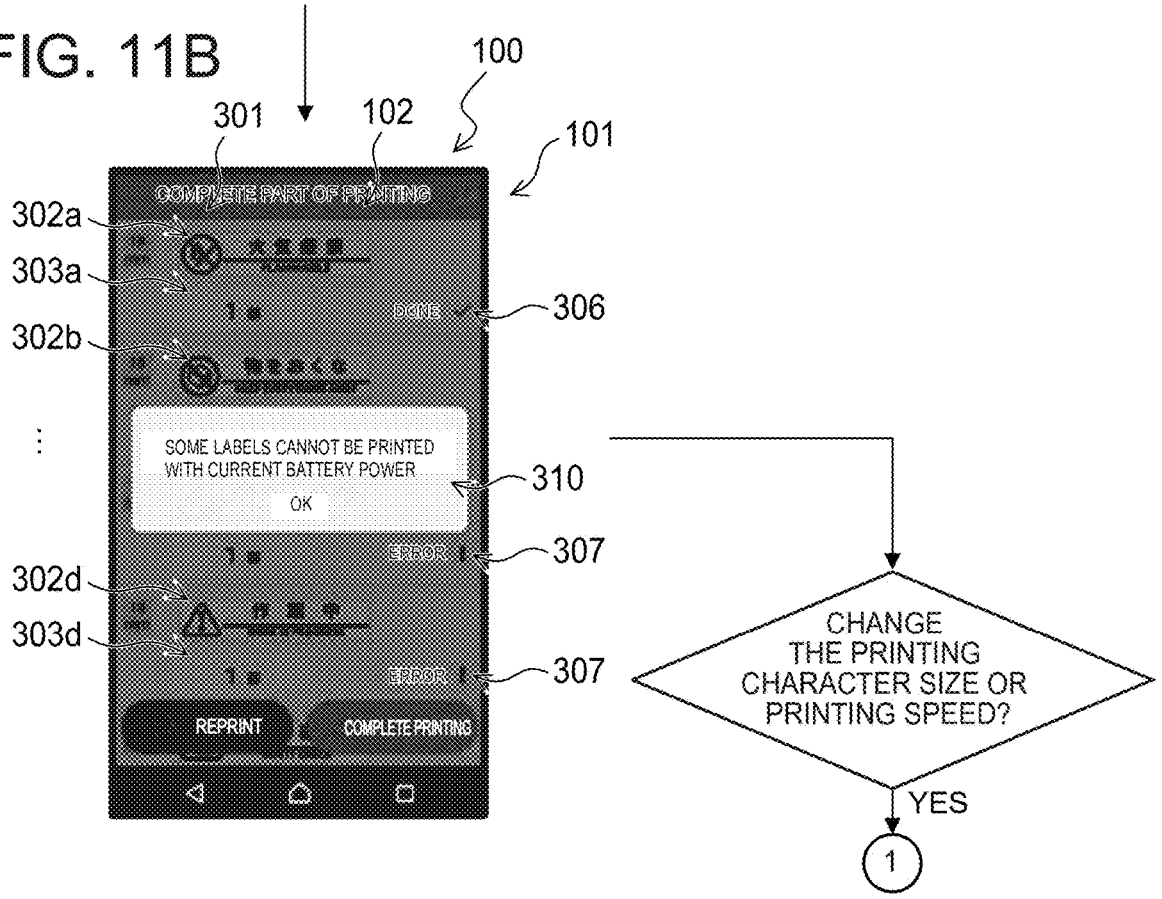

In the case where the user uses the input unit 102 to select a plurality of pieces of printing image data for printing images to be printed, from within the layout memory area for continuous printing in the RAM 106, the processor 107 displays printing images of the selected pieces of printing image data on the display unit 101, as shown in FIGS. 11A and 11B include. In FIGS. 11A and 11B include, the processor 107 displays a plurality of printing images 302*a* to 302*e* for the selected printing image data, in the continuous printing image display area 301 on the display unit 101. When the user selects the number of copies for a respective one of the printing images through the input unit 102, a printing medium group is established as a printing data unit corresponding to that printing image. For example, in FIGS. 11A and 11B include, the number of copies for the printing image 302*a* is set to be one, so one copy of printing image 302*a* constitutes one printing medium group as the printing data unit. Similarly, when the user selects the number of copies for the remaining printing images through the input unit 102, the printing medium group is also established for the respective one of the printing images 302*b* to 302*e*, as the corresponding printing data unit.

When the user depresses the print start button 305 through the input unit 102, the processor 107 accepts printing data including the information on the selected printing image data, constituted by the printing medium group(s), and transmits the accepted data to the printing apparatus 1.

The printing apparatus 1 estimates the number of printable labels that can be printed on the printing medium M, on the basis of the printing data received from the electronic device 100 and the remaining battery level of the battery D. In the example in FIGS. 11 and 12, it is assumed that the result of calculation by the printing apparatus 1 indicates, as the information on the number of printable labels, that only the printable image 302*a*, among the printing images 302*a* to 302*e* included in the printing data, can be printed in consideration of the number of printable labels. An exemplary way for the printing apparatus 1 to estimate the number of printable labels will be described later.

As a result of the calculation by the printing apparatus 1, when only a part of the printing data can be printed with the current remaining battery level, or, when printing of only the printing image 302*a* out of the printing images 302*a* to 302*e* included in the printing data can be completed within the current remaining battery level, then the information on the number of printable labels together with information on the error notification is transmitted from the printing apparatus 1 to the electronic device 100. The information on the number of printable labels may include information in units of pixels (dots) for the number of printable labels, or information in units of lines in the sub-scanning direction of the printing medium M.

When the error notification is received from the printing apparatus 1, the processor 107 displays the number of printable labels. More specifically, the processor 107 displays the number of printable labels, in units of printing data that can be printed on the printing medium M among the plurality of pieces of printing data. On the basis of the information on the number of printable labels, the processor 107 displays, in printing data units, the printing image(s) whose labels can be printed within the number of labels that can be printed on the printing medium M, from among the printing images corresponding to the plurality of pieces of printing data. Specifically, as shown in FIG. 11B, the processor 107 displays a DONE mark 306 for the printing image 302*a* whose labels can be printed within the number of printable labels, and displays an ERROR mark 307 for the remaining printing image 302*d* whose labels cannot be printed within the number of printable labels, among the printing images 302*a* to 302*d* displayed in the continuous printing image display area 301 on the display unit 101. Although not shown in the figure, the processor 107 displays the DONE mark 306 or the ERROR mark 307 for each of the printing images 302*a* to 302*e*.

Further, as shown in FIG. 11B, when receiving the error notification, the processor 107 can also display a message 310 indicating that there is/are printing image(s) whose label(s) cannot be printed, in the continuous printing image display area 301. In the second embodiment, the processor 107 displays, as the message 310, a warning reading: "SOME LABELS CANNOT BE PRINTED WITH CURRENT BATTERY POWER". The display, however, is not limited thereto. Any content allowing the user to understand that labels cannot be printed for some printing images due to insufficient battery level remaining can be displayed.

When the user who has confirmed that there is/are printing image(s) whose label(s) cannot be printed inputs through the input unit 102 the manipulation of changing any of the printing character size, printing density, number of copies, printing tape length, printing tape width, printing speed, and the like, the processor 107 re-creates printing data on the basis of the input information.

For example, as shown in FIG. 12A, when the user inputs through the input unit 102 the manipulation of changing the printing speed to do high-speed printing, the processor 107 accepts the change of the printing speed, and sets the printing speed to high. The processor 107 displays in the continuous printing image display area 301 a message 311 indicating that high-speed printing will be performed to do continuous printing with reduced battery drive time.

Further, as shown in FIG. 12B, when the user inputs through the input unit 102 the manipulation of changing the printing character size, the processor 107 accepts the change of the printing character size, and changes the printing character size. The processor 107 displays in the continuous printing image display area 301 a message 312 indicating that changing the character size enables continuous printing to the end. That is, the user can recognize that, while a label of only the printing image 302*a* could be printed before changing the character size, labels of the remaining printing images 302*b* to 302*e* can also be printed by changing the character size. With this, the failure in printing and, hence, waste of printing can be avoided, and further, the user can recognize the way of doing printing successfully with the current remaining battery level. This enhances the convenience for the user.

When the user who has seen the message 312 uses the input unit 102 to perform a pinching gesture on the characters in an edit area 340 on the display unit 101, as shown for example in FIG. 12C, to reduce the character size of the printing image 302*b* to let it fall within the range that can be printed with the current remaining battery level, the processor 107 accepts the change of the character size. As a result, the character size of the printing image 302*b* is changed, as shown in FIG. 12D, and the printing image data is re-created.

Although not shown in the figure, when the user uses the input unit 102 to manipulate the information on the printing density, number of copies, printing tape length, printing tape width, or the like arbitrarily in the similar manner as the information on the character size or the printing speed, the processor 107 re-creates printing image data on the basis of the manipulated printing density, number of copies, printing tape length, printing tape width, or the like. The processor 107 then re-transmits the information including the re-created printing image data, printing density, number of copies, printing tape length, printing tape width, printing speed, and the like, as printing data, to the printing apparatus 1. That is, when the processor 107 in the second embodiment receives information on the number of printable labels from the printing apparatus 1 and subsequently accepts the modification to the printing data, the processor 107 transmits the modified printing data to the printing apparatus 1 again.

The printing apparatus 1 re-calculates the number of printable labels that can be printed on the printing medium M, on the basis of the re-transmitted printing data and the remaining battery level of the battery D. In the case where the calculation result shows that only a part of the printing data can be printed with the current remaining battery level, the information on the number of printable labels together with information on the error notification is re-transmitted from the printing apparatus 1 to the electronic device 100.

The user can change the printing character size, printing density, number of copies, printing tape length, printing tape width, printing speed, or the like repeatedly until such changes of the printing character size or the like yield the state where there comes no error notification from the printing apparatus 1 and there exists no printing image whose labels cannot be printed, and thus, the desired printing can be done without fail.

In the second embodiment, the processor 107 displays, for a respective one of the printing images 302*a* to 302*e*, the DONE mark 306 for the printing image for which all the desired number of copies can be printed, and the ERROR mark 307 for the printing image for which not all the desired number of copies can be printed. The display manner, however, is not limited thereto. All that is needed is that the printing image whose labels can all be printed and the printing image whose labels cannot all be printed are displayed in such a manner that the user can visually distinguish them. For example, they can be displayed with different transmittance levels, different colors, different patterns, different brightness, different shading, or the like.

Figure 13:
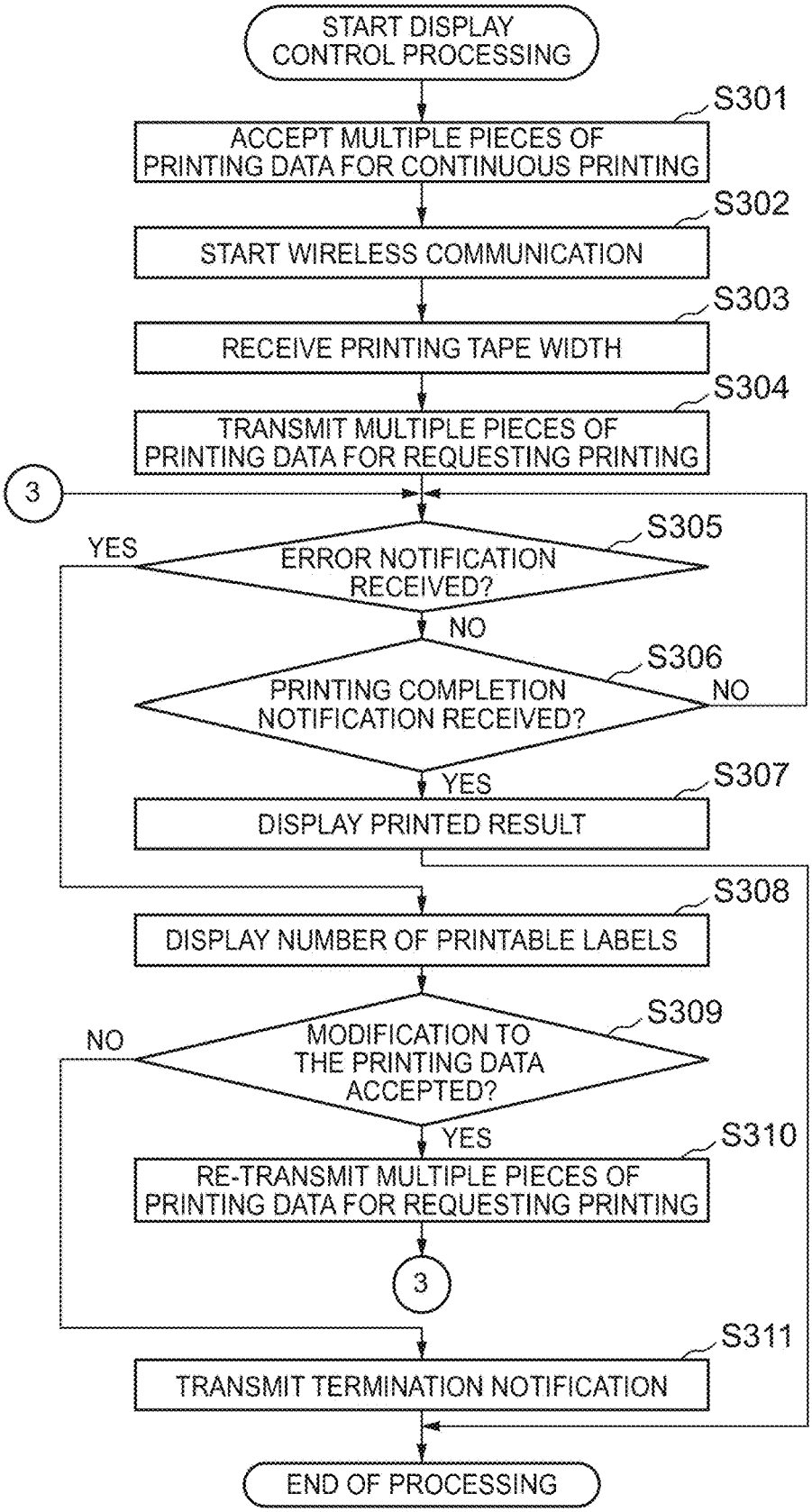
FIG. 13 is a flowchart illustrating display control processing in the electronic device in the second embodiment.

Display control processing in the second embodiment will now be described with reference to FIG. 13. FIG. 13 is a flowchart illustrating the display control processing in the second embodiment. The display control processing in the second embodiment is basically identical to the display control processing in the first embodiment illustrated in the flowchart in FIG. 9. The processes in steps S302, S303, S305, S306, S307, and S311 in the second embodiment are identical to those in the steps S102, S103, S105, S106, S107, and S111 in the first embodiment, so the description thereof will not be repeated. Only the points different from the first embodiment will be described below.

The electronic device 100 starts the display control processing shown in FIG. 13 in accordance with the order to start printing. In the display control processing, the processor 107 executes an application program of the electronic device 100 and accepts the user manipulation of selecting printing image data through the input unit 102, and takes a plurality of pieces of printing image data for continuous printing from the layout memory area for continuous printing in the RAM 106. The processor 107 accepts through the input unit 102 the printing density, number of copies, and character size for the obtained pieces of printing image data for continuous printing. The processor 107 accepts information including the created printing image data, printing density, and number of copies, as the plurality of pieces of printing data for continuous printing (step S301). The processor 107 stores the accepted printing data in the RAM 106.

The processor 107 transmits to the printing apparatus 1 printing data including the information on the selected printing image data for continuous printing, which is constituted by printing medium groups, for requesting printing this time (step S304).

The printing apparatus 1 estimates the number of printable labels that can be printed on the printing medium M, on the basis of the printing data received in the step S304 and the remaining battery level of the battery D. Then, on the basis of the calculation result, if the printing apparatus 1 determines that only a part of the printing data can be printed with the current remaining battery level, the printing apparatus 1 transmits the information on the number of printable labels, necessary for display of the number of printable labels, as well as information on the error notification to the electronic device 100. An exemplary way of estimating the number of printable labels in the printing apparatus 1 will be described later.

The processor 107 receives, from the printing apparatus 1, information on the number of printable labels calculated in the printing apparatus 1 on the basis of the printing data transmitted in the step S304 and the remaining battery level. If the remaining battery power is insufficient for printing the desired number of labels, the information on the number of printable labels together with the information on the error notification is transmitted from the printing apparatus 1, so the processor 107 in the electronic device 100 receives the information.

If the error notification is received (YES in step S305), the processor 107 displays on the display unit 101 the number of printable labels, on the basis of the information on the number of printable labels transmitted from the printing apparatus 1 (step S308). In this process, on the basis of the information on the number of printable labels, the processor 107 displays the printing image(s) whose label(s) can be printed within the number of printable labels, in printing data units.

The processor 107 determines whether the modification to the printing data by the user has been accepted through the input unit 102 (step S309). If no modification to the printing data by the user has been accepted (NO in step S309), the processor 107 transmits to the printing apparatus 1 the termination notification notifying that the processing will be terminated without printing, and the display control processing is terminated.

On the other hand, in the state where the message 310 to the effect that labels cannot be printed for some printing images due to insufficient battery level remaining is being displayed as shown in FIG. 11B, when the user manipulates through the input unit 102 the information on any of the printing character size, printing density, number of copies, printing tape length, printing tape width, printing speed, and the like arbitrarily, the processor 107 determines that a modification to the printing data by the user has been accepted (YES in step S309). In this case, the processor 107 re-creates printing image data on the basis of the information on the manipulated printing character size, printing density, number of copies, printing tape length, printing tape width, printing speed, or the like.

The processor 107 then accepts the information including the re-created printing image data, printing density, number of copies, printing tape length, printing tape width, printing speed, and the like, as printing data, and re-transmits the data to the printing apparatus 1 as the plurality of pieces of printing data for requesting printing (step S310).

The printing apparatus 1 re-estimates the number of printable labels on the basis of the printing data re-transmitted in the step S310 and the remaining battery level. Then, on the basis of the calculation result, the printing apparatus 1 re-transmits information on the number of printable labels, necessary for display of the number of printable labels, to the electronic device 100. An exemplary way for the printing apparatus 1 to re-transmit the information on the number of printable labels to the electronic device 100 will be described later.

The process then proceeds to step S305 again, where the processor 107 determines again whether the error notification has been received. That is, the display control processing is repeatedly carried out until changes made by the user on the printing character size, printing density, number of copies, printing tape length, printing tape width, printing speed, or the like yield the state where there comes no error notification and it is thus possible to print all the desired printing images, or until the user ceases modifying the printing data.

Figure 14:
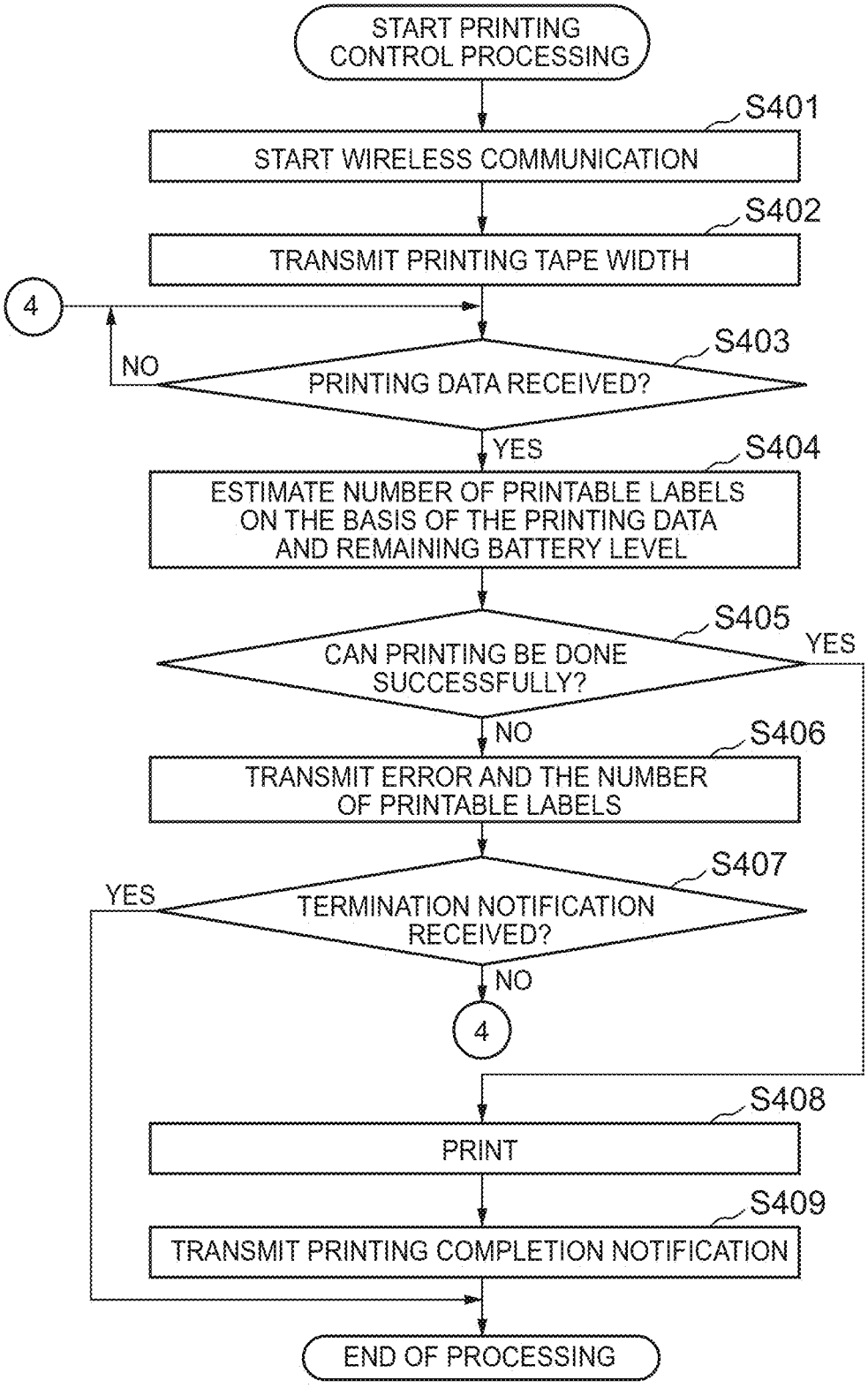
FIG. 14 is a flowchart illustrating printing control processing in the printing apparatus in the second embodiment.

Referring to FIG. 14, printing control processing performed by the printing apparatus 1 in the second embodiment will be described. FIG. 14 is a flowchart illustrating the printing control processing by the printing apparatus 1 in the second embodiment. In the printing control processing of the printing apparatus 1 in the second embodiment, the number of printable labels that can be printed on the printing medium M is estimated on the basis of the printing data transmitted from the electronic device 100 and the remaining battery level of the battery D. Then, on the basis of the calculation result, processing of transmitting to the electronic device 100 the information on the number of printable labels, necessary for the number of printable labels to be displayed in the electronic device 100, is performed. The printing control processing in the second embodiment is basically identical to the printing control processing in the first embodiment illustrated in the flowchart in FIG. 10. The processes in steps S401 and S402 in the second embodiment are identical to the processes in the steps S201 and S202 in the first embodiment, so the description thereof will not be repeated. Only the points different from the first embodiment will be described below.

The processor 5 determines whether printing data transmitted from the electronic device 100 has been received (step S403). If the printing data has not been received (NO in step S403), the process in the step S403 is repeated until the printing data is received, with the printing control processing placed in the standby mode. If the printing data is received (YES in step S403), the processor 5 estimates the number of printable labels, on the basis of the received printing data and the remaining battery level in the printing apparatus 1 (step S404). In this process, for example, the processor 5 calculates an electric power value to be fed to the thermal head 10, which is necessary for printing on the basis of the printing data. The processor 5 obtains the remaining battery level of the battery D in the printing apparatus 1, and calculates the amount of the number of lines or pixels (dots) that can be printed on the basis of the obtained remaining battery level. The processor 5 then estimates the number of printable labels, on the basis of the electric power value that needs to be fed to the thermal head 10 for performing printing and the amount of the number of lines or pixels (dots) that can be printed on the basis of the remaining battery level.

As a result of calculation in the step S404, if it is determined that the printing will not be able to be done successfully, for example when it is determined that only a part of the printing data can be printed in consideration of the number of printable labels based on the current remaining battery level (NO in step S405), the processor 5 transmits to the electronic device 100 the information on the number of printable labels together with information on the error notification (step S406). Thereafter, when the termination notification transmitted from the electronic device 100 (in step S311 in the display control processing in FIG. 13) is received (YES in step S407), the printing control processing is terminated without performing printing.

On the other hand, if no termination notification is received (NO in step S407), the process returns to step S403. In this case, printing data should be re-transmitted from the electronic device 100 (in step S310 in the display control processing in FIG. 13). When the printing data re-transmitted from the electronic device 100 is received (YES in step S403), the number of printable labels is re-estimated on the basis of the re-transmitted printing data and the remaining battery level (step S404). That is, the printing control processing is repeatedly carried out until it is determined that the printing can be done successfully (YES in step S405), or until the termination notification is received (YES in step S407).

If it is determined that the printing can be done successfully (YES in step S405), the processor 5 performs printing on the basis of the received printing data (step S408), and transmits the printing completion notification to the electronic device 100 (step S409). With this process done, the printing control processing is completed.

In the second embodiment, the number of printable labels is displayed on the display unit 101 as the limit (printing executable limit) within which printing is executable on the printing medium M on the basis of the remaining battery level in the printing apparatus 1. This allows the user who has seen the display screen to recognize the number of labels that can be printed. This prevents failure in printing and, hence, waste of printing due to the printing only partially done.

Further, it may also be configured such that the user who has seen the number of printable labels can change any of the printing character size, printing density, number of copies, printing tape length, printing tape width, printing speed, and the like, so that the desired printing can be completed within the current remaining battery level. With this, even in the case where the remaining battery level is insufficient, the printing can be continued under the conditions permitted by the user, so the failure in printing and, hence, the waste of printing due to insufficient battery level remaining can be avoided.

Furthermore, the number of printable labels that can be printed on the printing medium M is displayed in units of printing data whose labels can be printed on the printing medium M, among the plurality of pieces of printing data. This allows the user to recognize, at a glance, the piece(s) of printing data whose labels cannot be printed.

The printing data includes the information on the printing image data, the printing character size, printing density, number of copies, printing tape length, printing tape width, printing speed, and the like. This allows the user who has seen the number of printable labels to change any of the printing image data, the printing character size, printing density, number of copies, printing tape length, printing tape width, printing speed, and the like arbitrarily, so that the desired printing can be completed within the remaining battery level of the battery D in the printing apparatus 1. With this, it is possible to prevent the failure in printing and, hence, the waste of printing.

The above embodiments have been shown as specific examples for ease of understanding of the invention. The present invention is not limited to those embodiments. Various modifications or alternations are possible to the printing apparatus, printing control terminal, printing apparatus controlling method, printing control terminal controlling method, and recording media, within the range not departing from the scope defined by the claims.

While the thermal printer has been given as an example in the above embodiments, the printing method is not limited thereto; a printing apparatus may be one utilizing a different printing method such as inkjet printing.

While the battery has been given as an example of power for driving the printing apparatus 1 in the above embodiments, the battery may be any of the primary batteries such as a manganese battery and an alkaline battery, and the secondary batteries such as a nickel hydrogen battery and a lithium-ion battery. Further, not limited to the example where the battery is placed in a battery holder disposed on a side or bottom surface of the apparatus chassis 2, a secondary battery may be disposed on a side or bottom surface of the apparatus chassis 2 and charged with electric power from an external power source via an AC adapter.

REFERENCE SIGNS LIST

1: printing apparatus; 2: apparatus chassis; 2*a*: discharge port; 3: open/close cover; 3*a*: window; 5: processor; 6: ROM; 7: RAM; 8: communication IF; 10: thermal head; 10*a*: heating element; 12: stepping motor; 13: thermistor; 15: cutter motor; 16: half cutting mechanism; 17: full cutting mechanism; 19: cassette compartment; 20: cassette receiving section; 21: platen roller; 22: tape core engagement shaft; 23: ink ribbon take-up drive shaft; 24: tape width detection switch; 25: power button; 26: manipulation button; 27: cover open button; 30: tape cassette; 31: cassette case; 32: tape core; 34: ink ribbon supply core; 35: ink ribbon take-up core; 36: thermal head insertion section; 37: engagement section; 40: power supply circuit; 100: electronic device; 101: display unit; 102: input unit; 104: communication IF; 105: ROM; 106: RAM; 107: processor; M: printing medium; R: ink ribbon; and D: battery.

What is claimed is:

1. A printing apparatus, comprising:

a printing head that prints printing data on a printing medium by electric power supplied from a battery; and a processor, the processor being operable to:

determine, based on first printing data indicating information on a first printing content to be printed on the printing medium and a remaining battery level of the battery, whether the first printing data can be printed, and transmit, to an external terminal, first printing data modification information to modify the first printing data so that printing of the first printing data can be performed with the remaining battery level.

2. The printing apparatus according to claim 1, wherein the processor is operable to:

in response to receiving a termination notification instructing termination of printing from the external terminal following the transmission of the first printing data modification information, terminate the printing by the printing head, and in response to receiving second printing data indicating information on a second printing content following the transmission of the first printing data modification information, estimate, based on the received second printing data and the remaining battery level of the battery, a second printing executable range which is a range in the second printing content that can be printed on the printing medium, and transmit information indicating the second printing executable range to the external terminal.

3. The printing apparatus according to claim 2, further comprising:

a communication IF for performing communication with the external terminal, wherein the communication IF receives the first printing data and the second printing data from the external terminal and transmits the first printing data modification information and the second printing executable range to the external terminal.

4. A controlling method of a printing apparatus, the printing apparatus including a printing head that prints printing data on a printing medium by electric power supplied from a battery and a processor, and the method comprising:

determining, based on first printing data indicating information on a first printing content to be printed on the printing medium and a remaining battery level of the battery, whether the first printing data can be printed; and transmitting, to an external terminal, first printing data modification information to modify the first printing data so that printing of the first printing data can be performed with the remaining battery level.

5. A non-transitory computer-readable recording medium having recorded thereon a program executable by a computer controlling a printing apparatus, the apparatus including a printing head that prints printing data on a printing medium by electric power supplied from a battery and a processor, and the program controlling the processor to execute processing comprising:

determining, based on first printing data indicating information on a first printing content to be printed on the printing medium and a remaining battery level of the battery, whether the first printing data can be printed; and transmitting, to an external terminal, first printing data modification information to modify the first printing data so that printing of the first printing data can be performed with the remaining battery level.

6. The printing apparatus according to claim 1, wherein the processor is further operable to:

estimate, based on the first printing data and the remaining battery level of the battery, a first printing executable range which is a range in the first printing content that can be printed on the printing medium, and transmit, to the external terminal, information indicating the first printing executable range.

* * * * *